US008712292B2

(12) United States Patent
Kobayashi

(10) Patent No.: US 8,712,292 B2
(45) Date of Patent: Apr. 29, 2014

(54) COLOR IMAGE FORMING APPARATUS WITH CONTACT CONTROL OF PROCESS UNITS

(75) Inventor: Nobuyuki Kobayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 13/208,911

(22) Filed: Aug. 12, 2011

(65) Prior Publication Data

US 2012/0045228 A1 Feb. 23, 2012

(30) Foreign Application Priority Data

Aug. 20, 2010 (JP) ..... 2010-185566

(51) Int. Cl.
*G03G 15/01* (2006.01)
*G03G 15/00* (2006.01)

(52) U.S. Cl.
USPC ..... 399/227; 399/49; 399/82

(58) Field of Classification Search
CPC ..... G03G 15/5054; G03G 15/0173; G03G 15/5058; G03G 15/01
USPC ..... 399/40, 227, 44, 48, 82, 49
See application file for complete search history.

(56) References Cited

U.S. PATENT DOCUMENTS

| | | | | |
|---|---|---|---|---|
| 6,094,557 | A | 7/2000 | Shinohara | |
| 6,701,110 | B2 | 3/2004 | Ono | |
| 7,729,641 | B2 * | 6/2010 | Suzuki | 399/82 |
| 2002/0037174 | A1 * | 3/2002 | Fujita | 399/44 |
| 2012/0045256 | A1 | 2/2012 | Sasaoka et al. | |

FOREIGN PATENT DOCUMENTS

| | | | |
|---|---|---|---|
| JP | 8-171253 | A | 7/1996 |
| JP | 8-286566 | A | 11/1996 |
| JP | 2000-066475 | A | 3/2000 |
| JP | 2000-221748 | A | 8/2000 |
| JP | 2000-231236 | A | 8/2000 |
| JP | 2001-100514 | A | 4/2001 |
| JP | 2001-134037 | A | 5/2001 |
| JP | 2002-14545 | A | 1/2002 |
| JP | 2002-116595 | A | 4/2002 |
| JP | 2002-351182 | A | 12/2002 |
| JP | 2003-215886 | A | 7/2003 |
| JP | 2005-266338 | A | 9/2005 |
| JP | 2005-316202 | A | 11/2005 |
| JP | 2005-352122 | A | 12/2005 |

(Continued)

OTHER PUBLICATIONS

Notification of Reasons for Refusal issued Jul. 31, 2012, in Japanese Application No. 2010-185566.

*Primary Examiner* — Susan Lee
(74) *Attorney, Agent, or Firm* — Fitzpatrick, Cella, Harper & Scinto

(57) ABSTRACT

The color image forming apparatus performs registration control and is operable in first and second image forming modes. Contact control in the first image forming mode is different from that in the second image forming mode. The control section causes an alignment correction amount to vary between registration control corresponding to image forming for a second or subsequent sheet in the first image forming mode and registration control corresponding to image forming for a second or subsequent sheet in the second image forming mode. An engine control section causes a color deviation correction amount for contact control of a process unit when shifting from image forming for a first sheet to image forming for a second sheet to vary between the first and second image forming modes.

21 Claims, 14 Drawing Sheets

(56) References Cited

FOREIGN PATENT DOCUMENTS

| | | | |
|---|---|---|---|
| JP | 2006-11317 | A | 1/2006 |
| JP | 2006-91141 | A | 4/2006 |
| JP | 2007-304201 | A | 11/2007 |
| JP | 2008-9107 | A | 1/2008 |
| JP | 2008-33007 | A | 2/2008 |
| JP | 2012-42834 | A | 3/2012 |

* cited by examiner

| | | t1 | | | t2 | | |
|---|---|---|---|---|---|---|---|
| FIXING WARNING-UP STATUS | ATVC RESULT | M | C | Bk | M | C | Bk |
| WARNING-UP STATUS a | V1a | t1(M1a) | t1(C1a) | t1(K1a) | t2(M1a) | t2(C1a) | t2(K1a) |
| | V2a | t1(M2a) | t1(C2a) | t1(K2a) | t2(M2a) | t2(C2a) | t2(K2a) |
| | V3a | t1(M3a) | t1(C3a) | t1(K3a) | t2(M3a) | t2(C3a) | t2(K3a) |
| WARNING-UP STATUS b | V1b | t1(M1b) | t1(C1b) | t1(K1b) | t2(M1b) | t2(C1b) | t2(K1b) |
| | V2b | t1(M2b) | t1(C2b) | t1(K2b) | t2(M2b) | t2(C2b) | t2(K2b) |
| | V3b | t1(M3b) | t1(C3b) | t1(K3b) | t2(M3b) | t2(C3b) | t2(K3b) |
| WARNING-UP STATUS c | V1c | t1(M1c) | t1(C1c) | t1(K1c) | t2(M1c) | t2(C1c) | t2(K1c) |
| | V2c | t1(M2c) | t1(C2c) | t1(K2c) | t2(M2c) | t2(C2c) | t2(K2c) |
| | V3c | t1(M3c) | t1(C3c) | t1(K3c) | t2(M3c) | t2(C3c) | t2(K3c) |

COLOR IMAGE FORMING APPARATUS WITH CONTACT CONTROL OF PROCESS UNITS

BACKGROUND OF THE INVENTION

1. Field of the Invention

The present invention relates to a color image forming apparatus such as a color copier or color printer that uses an electrophotographic method.

2. Description of the Related Art

A color image forming apparatus that forms a color image on a recording medium by sequentially superimposing toner images of the four colors of yellow, cyan, magenta and black on the recording medium is already known. In this kind of color image forming apparatus, if the position at which images of a plurality of colors are superposed deviates relatively between the colors, an error referred to as a "color deviation", that is, positional deviation of image, occurs. Consequently, it is necessary to align the toner images of the respective colors that are superposed on the recording medium, as accurately as possible.

In recent years, there is a demand for image forming apparatuses to achieve faster printing and to reduce the time a user waits from when a print job is input until the first sheet is printed out. Although the actual operations for outputting a color image and the preparatory operations therefor had previously been carried out sequentially, in response to the aforementioned demands for faster printing and reduced waiting times, image forming apparatuses now execute control to perform such operations in parallel. As an example of an operation that is performed in parallel with a certain electrophotographic process operation, contact of a cleaning blade or a transfer unit against an intermediate transfer member or separation of the cleaning blade or transfer unit therefrom can be mentioned. However, a load change arises due to a mechanical shock that occurs when a cleaning blade or a transfer unit contacts against or is separated from contact with an intermediate transfer member, and a slight error arises in a peripheral length value that is detected. As a result, there is the problem that an error occurs with respect to the alignment of the toner images of each color and consequently a color deviation occurs. Therefore, Japanese Patent Application Laid-Open No. 2000-066475 discloses technology in which a correction value used for color deviation correction control is switched between a time of forming an image on a first sheet that does not receive the influence of contact or separation of a transfer unit or a cleaning blade, and a time of forming an image on a second or subsequent sheet does receive the influence of such contact or separation.

In this connection, in recent years the types of media (recording medium) that are used for printing by image forming apparatuses have become more diverse, and some image forming apparatuses include a plurality of image forming modes to correspond to a variety of media types. For example, such image forming apparatuses perform image forming by varying a fixing temperature or an image forming speed in accordance with respective image forming modes such as a plain paper mode, a thick paper mode, and a glossy paper mode. More specifically, there is a desire to suppress a color deviation that is caused by the above described mechanical shock in a manner that also corresponds to each of these image forming modes.

SUMMARY OF THE INVENTION

A purpose of the present invention is to solve at least one of the above described problem and other problems.

Another purpose of the present invention is to perform registration control that corresponds to a plurality of image forming modes when performing continuous printing of a plurality of pages while achieving miniaturization of the apparatus and a shorter wait time.

A further purpose of the present invention is to provide a color image forming apparatus, including a first process unit that includes a photosensitive drum and a rotary image bearing member for transferring a toner image formed on the photosensitive drum, or a conveyance member that conveys a recording medium onto which the toner image is transferred, a detection section that detects a mark formed on the image bearing member or the conveyance member, wherein according to a detection of the mark by the detection section, the color image forming apparatus performs contact control in which the first process unit contacts with a second process unit, or the second process unit is separated from a state in which the second process unit contacts with the first process unit to form a toner image on the image bearing member or the recording medium, and image forming after stand-by of for a further time period, and the color image forming apparatus repeatedly performs the contact control and the image forming for each of sheets, and a control section that, when an image is formed for a first sheet, performs the contact control for the second process unit and also performs first registration control that corresponds to image forming for a first sheet according to a detection of the mark by the detection section, and when an image is formed for a second sheet or subsequent sheets of the second sheet, performs the contact control for the second process unit and also performs second registration control that corresponds to image forming for a second or subsequent sheet according to a detection of the mark by the detection section, wherein the color image forming apparatus is operable in a first image forming mode and in a second image forming mode in which a conveyance speed of a recording medium when a toner image is fixed onto the recording medium is different from a conveyance speed of a recording medium in the first image forming mode, the contact control in the first image forming mode being different from the contact control in the second image forming mode; and the control section differentiates a correction amount for an alignment in the second registration control in the first image forming mode from a correction amount for alignment in the second registration control in the second image forming mode.

A still further purpose of the present invention is to provide a color image forming apparatus, including a first process unit that includes a photosensitive drum and a rotary image bearing member for transferring a toner image formed on the photosensitive drum, or a conveyance member that conveys a recording medium onto which the toner image is transferred, a detection section that detects a mark formed on the image bearing member or the conveyance member, wherein according to a detection of the mark by the detection section, the color image forming apparatus performs contact control in which a developing device contacts with the photosensitive drum, or the second process unit is separated from a state in which the developing device contacts with the photosensitive drum to form a toner image on the photosensitive drum, and image forming after stand-by of for a further time period, and the color image forming apparatus repeatedly performs the contact control and the image forming for each of sheets; and a control section that, when an image is formed for a first sheet, performs the contact control for the developing device and also performs first registration control that corresponds to image forming for a first sheet according to a detection of the mark by the detection section, and when an image is formed for a second sheet or subsequent sheets of the second sheet, performs the contact control for the developing device and also performs second registration control that corresponds to image forming for a second or subsequent sheet according to a detection of the mark by the detection section, wherein the color image forming apparatus is operable in a first image forming mode and in a second image forming mode, the contact control in the first image forming mode being different from the contact control in the second image forming mode, and the control section differentiates a correction amount for alignment in the second registration control in the first image forming mode from a correction amount for alignment in the second registration control in the second image forming mode.

A still further feature of the present invention will become apparent from the following description of exemplary embodiments with reference to the attached drawings.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Exemplary embodiments of the present invention are described below in detail with reference to the accompanying drawings. Note that constituent elements described in the exemplary embodiments are merely examples, and the scope of the present invention is not limited thereto.

Embodiment 1

Figure 1:
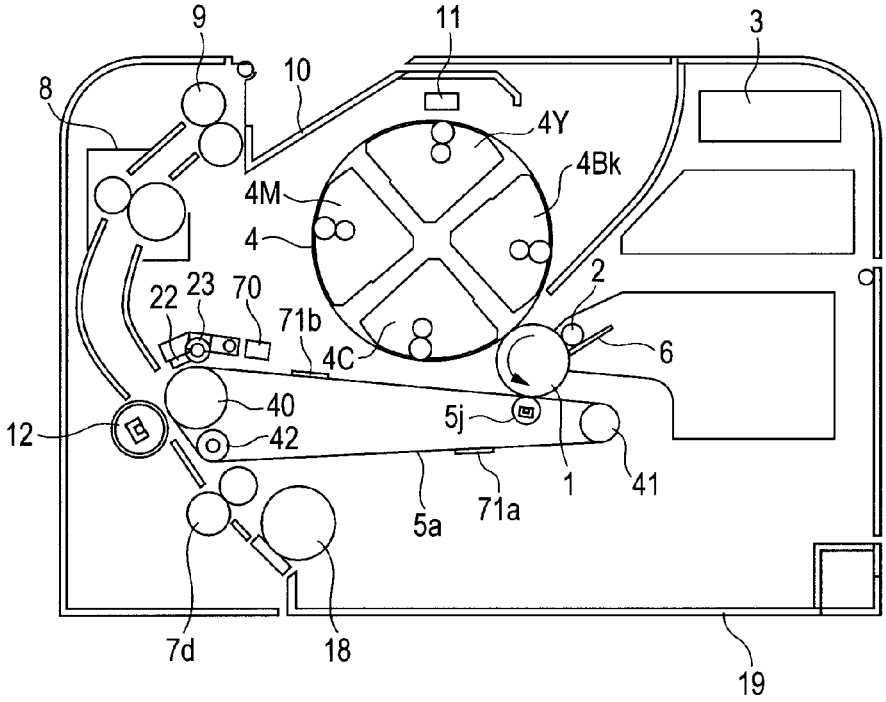
FIG. 1 is a sectional view that illustrates the configuration of an image forming apparatus according to Embodiment 1.
Figure 2A:
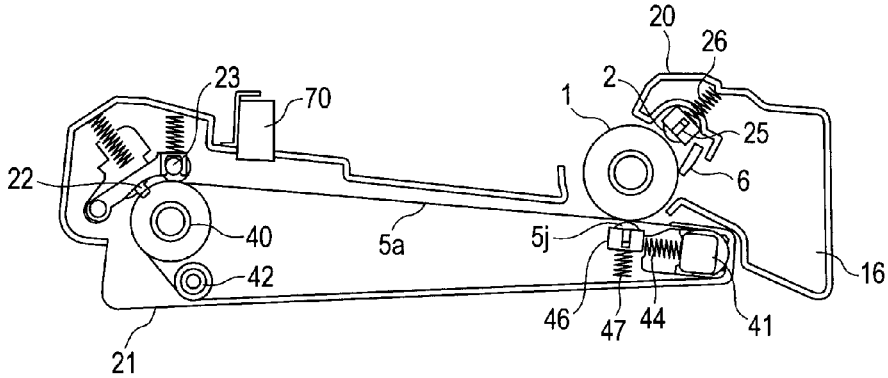
FIG. 2A and FIG. 2B are views that illustrate an intermediate transfer belt unit and a drum cartridge unit according to Embodiments 1 and 2.

FIG. 1 is a sectional view of an electrophotographic image forming apparatus according to Embodiment 1. FIG. 2A is a sectional view of a photosensitive drum unit and an intermediate transfer belt unit. As shown in FIG. 1, according to the present embodiment, a rotary (rotary developing device) type four-cycle full-color printer is described as an example of an electrophotographic image forming apparatus.

{Outline of Image Forming Operations of Color Image Forming Apparatus}

An intermediate transfer belt 5*a* (image bearing member) is put on a drive roller 40, a tension roller (first follower roller) 41, and an idler roller (second follower roller) 42 in a tensioned state. A photosensitive drum 1 (first process unit) rotates in the direction of an arrow (counterclockwise rotation) shown in FIG. 1, in synchronization with rotation of the intermediate transfer belt 5*a*. A charging device 2 uniformly charges the surface of the photosensitive drum 1. An exposure device 3 as an exposure section performs exposure of a yellow (Y) image to form a yellow electrostatic latent image on the photosensitive drum 1. A rotary developing device 4 is driven in parallel with the electrostatic latent image forming, and disposes a developing device 4Y for yellow at a development position. The rotary developing device 4 is an example of a unit that functions as a developing device for respective colors and also as a second process unit. At this time, driving is transmitted to the developing device 4Y by an unshown development coupling to rotate the developing device 4Y. The development coupling includes a development coupling on the developing device side that is provided at an end on the developing device side, and a development coupling on the main unit side to which the developing device-side coupling is linked. The developing device 4Y applies a voltage of the same polarity as the charging polarity and substantially the same potential as the potential of the photosensitive drum 1 onto the photosensitive drum 1 so that yellow toner adheres to the electrostatic latent image on the photosensitive drum 1, whereby yellow toner is adhered to the electrostatic latent image and develop the latent image. Thereafter, a voltage of an opposite polarity to that of the toner is applied to a primary transfer roller 5*j* inside the intermediate transfer belt unit to perform primary transfer of the yellow toner image from the photosensitive drum 1 onto the intermediate transfer belt 5*a*.

Upon completing primary transfer of the yellow toner image in this manner, the next developing device (for example, a developing device 4M) is rotationally moved, and positioned at the development position facing the photosensitive drum 1. In a similar manner to the yellow toner image forming of an electrostatic latent image, development of the latent image and primary transfer of a toner image are performed in sequence for magenta (M), cyan (C), and black (Bk), respectively, and thus toner images of four colors are superposed on the intermediate transfer belt 5*a*. In this case, the position of the rotary developing device 4 at that time is detected by a rotary position detecting sensor 11, and is controlled by an engine control section that is described later. During this process, a secondary transfer roller 12 (second process unit) is in a state of non-contact (separation) with respect to the intermediate transfer belt 5*a*. At this time, a charging brush 22 and a charging roller 23 as a cleaning unit are also in a state of non-contact with respect to the intermediate transfer belt 5*a*.

After toner images with four colors are completely formed on the intermediate transfer belt 5*a*, the secondary transfer roller 12 is brought into contact with the intermediate transfer belt 5*a* (first process unit) (state illustrated in FIG. 1). In this specification, herein, control is defined as "contact control" in which the secondary transfer roller 12 contacts the intermediate transfer belt 5*a* or separates the secondary transfer roller from the intermediate transfer belt 5*a*. Further, in synchronization with rotation of the intermediate transfer belt 5*a*, a recording medium that is stored in a paper cassette 19 as a recording medium loading unit is separated one sheet at a time from the paper cassette 19 and fed to a conveyance path by a pickup roller 18. The recording medium is held in standby at a predetermined position by a pair of conveying rollers 7*d* as a paper re-feeding unit, and then fed into a nip part between the intermediate transfer belt 5*a* and the secondary transfer roller 12. In this case, a registration sensor (not shown) is provided immediately in front of the pair of conveying rollers 7*d*. The registration sensor detects the leading edge of the recording medium, and temporarily cuts off a rotational driving force of the pair of conveying rollers 7*d* to hold the recording medium on standby at the predetermined position. Further, a voltage of a reverse polarity to that of the toner is applied to the secondary transfer roller 12, and the toner images on the intermediate transfer belt 5*a* undergo secondary transfer in a collective manner onto the surface of the recording medium that has been conveyed. The recording medium onto which the toner images of four colors have undergone secondary transfer in this manner is conveyed to a fixing device 8. The fixing device 8 fixes the toner images of a plurality of colors on the recording medium. Thereafter, the recording medium is discharged onto a paper discharge tray 10 at the upper part of the color image forming apparatus by a pair of discharge rollers 9 so that the image forming is completed.

After the secondary transfer, the charging brush 22 and the charging roller 23 (second process unit) for cleaning are brought into contact with the intermediate transfer belt 5*a*, and apply a charge that is the opposite to the charge applied at the time of transfer to residual toner that remains on the intermediate transfer belt 5*a*. The residual toner to which the opposite charge is applied is electrostatically adhered to the photosensitive drum 1, and thereafter is collected by means of a cleaning blade 6 for the photosensitive drum 1.

{Intermediate Transfer Belt Unit and Photosensitive Drum Unit}

Figure 2B:
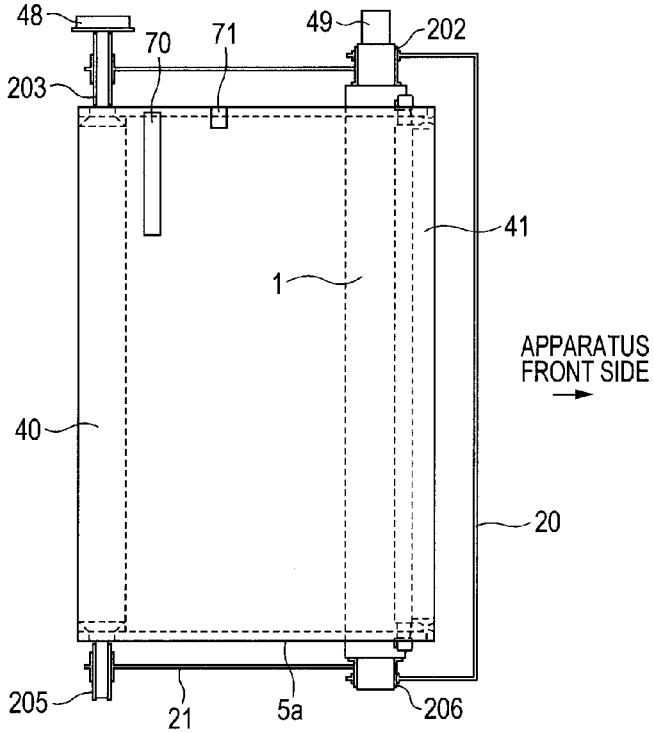

FIG. 2A is a main sectional view of an intermediate transfer belt unit 21 and a photosensitive drum unit 20. FIG. 2B is a transverse sectional view as viewed from above of the intermediate transfer belt unit 21 and the photosensitive drum unit 20 shown in FIG. 2A. In FIG. 2A and FIG. 2B, the photosensitive drum unit 20 is disposed on an upper projection plane of the intermediate transfer belt 5*a* that is suspended in a tensioned state on the drive roller 40, the tension roller 41, and the idler roller 42 of the intermediate transfer belt unit 21. A waste toner box 16 is disposed on the side of the photosensitive drum unit 20 that is towards the front face of the apparatus (apparatus front side). A short belt is used as the intermediate transfer belt 5*a*. The peripheral length of the short belt is set so as to be equal to or greater than, but no more than twice the length of, the length in the long side direction of the longest recording medium for which image forming can be performed by the color image forming apparatus. For example, legal size or A4 size can be assigned as the largest size. More specifically, the size of the intermediate transfer belt 5*a* is miniaturized to a size such that A4 images of two pages can not be formed on the intermediate transfer belt 5*a* at the same time. The charging brush 22 and charging roller 23 for cleaning are provided at the drive roller 40 of the intermediate transfer belt unit 21 in order to apply a charge of a reverse polarity to the charge applied at the time of transfer to the residual toner on the intermediate transfer belt 5*a*.

In the photosensitive drum unit 20, the two ends of the photosensitive drum 1 are rotatably held by a right-side bearing 202 and a left-side bearing 206, and a predetermined rotational driving force is transmitted thereto from the main body of the apparatus through a coupling 49 on the right end portion thereof. Also, the charging device 2 is adapted to be brought into pressure contact with the photosensitive drum 1 with a predetermined force by a compression spring 26 through bearings 25 at both ends thereof, and be driven to rotate.

Next, the intermediate transfer belt unit 21 is described. The intermediate transfer belt 5*a* is suspended in a tensioned state on the drive roller 40, the tension roller 41, and the idler roller 42. Both ends of the drive roller 40 are rotatably held by a right-side bearing 203 and a left-side bearing 205, and a predetermined rotational driving force is transmitted thereto from the main body of the apparatus through a drive gear 48 in the right-side bearing portion. Compression springs 44 are provided on bearings on both ends of the tension roller 41 so as to impart a predetermined tension to the intermediate transfer belt 5*a*. The primary transfer roller 5*j* is provided at a location facing the photosensitive drum 1 with the intermediate transfer belt 5*a* interposed therebetween, and is adapted to be brought into pressure contact with the photosensitive drum 1 with a predetermined force by a compression spring 47 through bearings 46 at both ends thereof, and be driven to rotate. At least one of the bearings is constituted by an electrically conductive member, and when a predetermined bias voltage is applied to the primary transfer roller 5*j*, the toner images on the surface of the photosensitive drum 1 undergo primary transfer onto the intermediate transfer belt 5*a*. A photosensor 70 (detection section) as a position detection section is provided over the intermediate transfer belt 5*a* in order to detect a position in the conveying direction on the intermediate transfer belt 5*a* and carry out alignment of the toner images of each color that are superposed on the intermediate transfer belt 5*a*. Markers 71*a* and 71*b* that are light reflecting members are attached at two locations (see FIG. 1) that are outside the image forming region in the width direction (direction perpendicular to the recording medium conveying direction) of the intermediate transfer belt 5*a*. The photosensor 70 that is a reflective optical sensor is disposed at a predetermined position so as to face the markers 71*a* and 71*b*. The position in the conveying direction of the intermediate transfer belt 5*a* and an image writing start position are detected by detecting a reflected light from the markers 71 as light reflecting members, and a timing for writing image data onto the photosensitive drum 1 by means of the exposure device 3 is controlled in synchrony with the detection signal.

{System of the Image Forming Apparatus}

Figure 3:
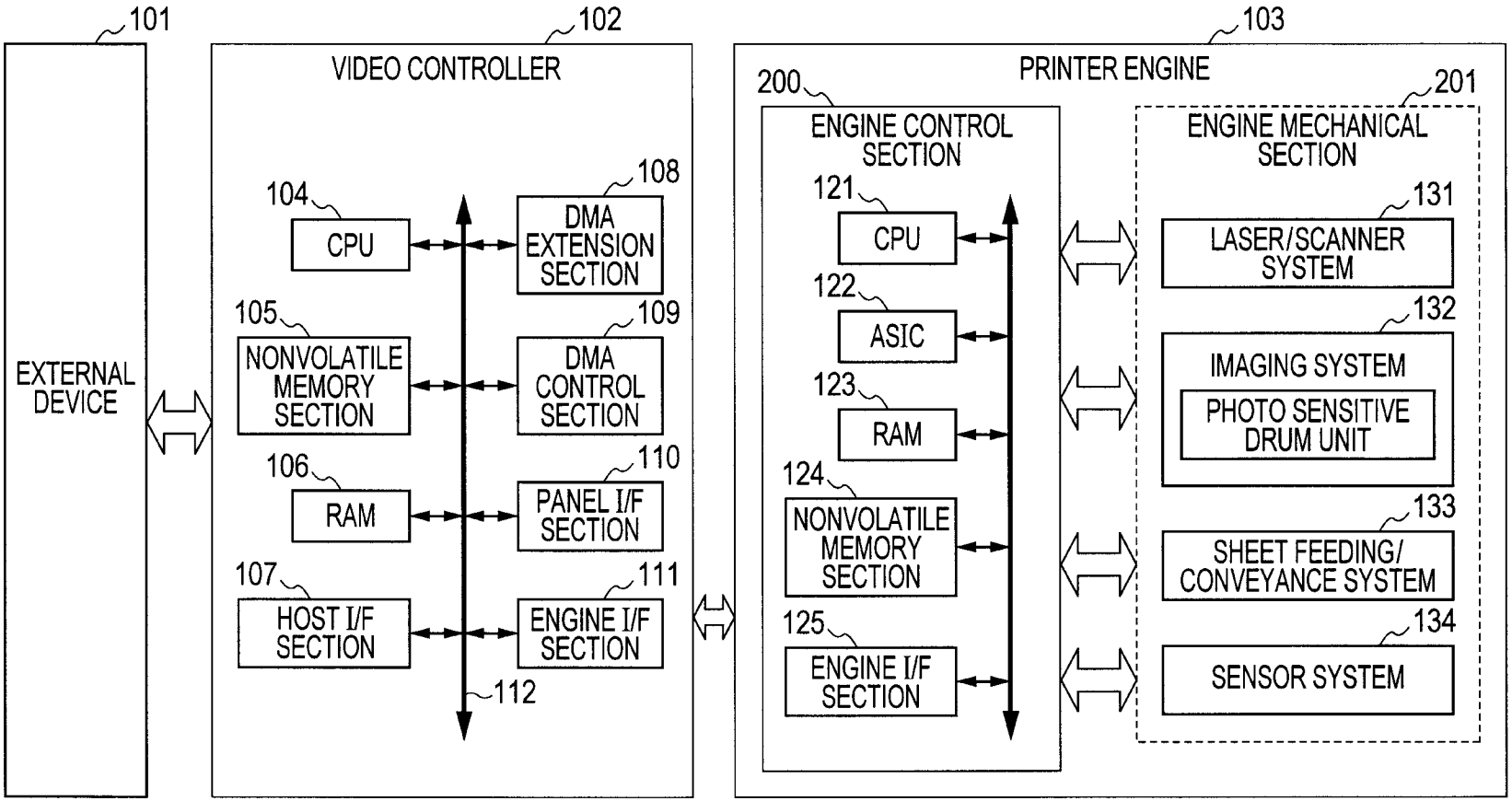
FIG. 3 is a hardware block diagram of the image forming apparatus according to Embodiments 1 and 2.

FIG. 3 illustrates a hardware block diagram of the image forming apparatus of the present embodiment. A video controller 102 thereof is described first. A CPU 104 performs overall control of the video controller 102. A nonvolatile memory section 105 that is a nonvolatile memory unit stores various control codes that the CPU 104 executes, and, for example, corresponds to a ROM, an EEPROM, or a hard disk. A RAM 106 is a RAM for temporary storage that functions as a main memory or work area of the CPU 104. A host interface section (hereunder, referred to as "host I/F section") 107 is an input/output section for input and output of print data and control data from and to an external device 101 such as a host computer. Print data received by the host I/F section 107 is stored as compressed data in the RAM 106. A data extension section 108 extends compressed data. Arbitrary compressed data stored in the RAM 106 is extended into image data in line units by the data extension section 108. The extended image data is stored in the RAM 106. In accordance with an instruction from the CPU 104, a DMA control section 109 transfers image data that is inside the RAM 106 to an engine interface section (hereunder, referred to as "engine I/F section") 111. The DMA control section 109 also transfers arbitrary compressed data stored in the RAM 106 to the data extension section 108, or transfers image data that is output from the data extension section 108 to the engine I/F section 111. A panel interface section (hereunder, referred to as "panel I/F section") 110 accepts various settings and instructions from an operator that are input from a panel section provided on the main body of the printer. The engine I/F section 111 is an input/output section for signals from and to a printer engine 103, and carries out the delivery of data signals from an unshown output buffer register as well as communication control with respect to the printer engine 103. A system bus 112 includes an address bus and a data bus. Each of the above described constituent elements are connected to the system bus 112 and can access each other.

Next the printer engine 103 is described. The printer engine 103 is broadly divided into an engine control section 200 and an engine mechanical section 201. The engine mechanical section 201 is a portion that operates according to various instructions from the engine control section 200. First, the engine mechanical section 201 is described in detail, and thereafter the engine control section 200 is described in detail. A laser/scanner system 131 includes a laser light emitting device, a laser driver circuit, a scanner motor, a rotating polygon mirror, and a scanner driver. The laser/scanner system 131 forms an electrostatic latent image on the photosensitive drum 1 by exposing and scanning the photosensitive drum 1 using a laser light beam in accordance with image data that is sent from the video controller 102. An imaging system 132 is the principal portion of the image forming apparatus, and is a part that forms a toner image based on the electrostatic latent image that is formed on the photosensitive drum 1 on a recording medium. The imaging system 132 includes process elements such as the photosensitive drum unit 20, the rotary developing device 4, the intermediate transfer belt unit 21, and the fixing device 8, as well as a high voltage power source circuit that generates various kinds of bias voltages (high voltages) when forming an image. The photosensitive drum unit 20 includes the charging device 2 and the photosensitive drum 1. An unshown non-volatile memory tag is also provided in the photosensitive drum unit 20. A CPU 121 or an ASIC 122 reads and writes various kinds of information from and to the memory tag. The imaging system 132 also includes unshown drive motors and motor drivers that drive the photosensitive drum 1, the drive roller 40 of the intermediate transfer belt 5*a*, and the fixing device 8.

A sheet feeding/conveyance system 133 is responsible for feeding and conveying a recording medium, and is constituted by various conveyance system motors, a sheet feeding tray and a discharge tray, and various conveyance rollers. A sensor system 134 is a group of sensors for collecting information that is required by the CPU 121 and the ASIC 122, which are described later, to control the laser/scanner system 131, the imaging system 132, and the sheet feeding/conveyance system 133. The group of sensors includes at least various sensors that are already known such as a temperature sensor of the fixing device 8, a remaining toner amount detection sensor, a density sensor that detects the density of an image, a sheet size sensor, a sheet leading edge detecting sensor, and a sheet conveyance detecting sensor. The sensor system 134 also includes the rotary position detecting sensor 11 that detects the position of the rotary developing device 4, and the photosensor 70 that detects the markers 71. The information detected by these various sensors is acquired by the engine control section 200 and used for print sequence control. In this connection, although the sensor system illustrated in the drawing is described by dividing the sensor system into the laser/scanner system 131, the imaging system 132, and the sheet feeding/conveyance system 133, those systems may be included in any one of the mechanisms.

Next, the engine control section 200 is described. The CPU 121 utilizes a RAM 123 as a main memory and work area, and controls the above described engine mechanical section 201 in accordance with various control programs stored in a non-volatile memory section 124. More specifically, the CPU 121 drives the laser/scanner system 131 based on print control commands and image data that is input from the video controller 102 through the engine I/F section 111 and an engine I/F section 125. The CPU 121 also controls various kinds of print sequences by controlling the imaging system 132 and the sheet feeding/conveyance system 133. Further, the CPU 121 drives the sensor system 134 to acquire information required for controlling the imaging system 132 and the sheet feeding/conveyance system 133. Based on instructions from the CPU 121, the ASIC 122 controls the various motors necessary for executing the above described various print sequences and controls a high voltage power source such as a developing bias voltage. Note that a part or all of the functions of the CPU 121 may be executed by the ASIC 122. Conversely, a part or all of the functions of the ASIC 122 may be executed by the CPU 121. A configuration may also be adopted in which dedicated hardware is separately provided, and a part of the functions of the CPU 121 or the ASIC 122 may be executed by the dedicated hardware.

Figure 4A:
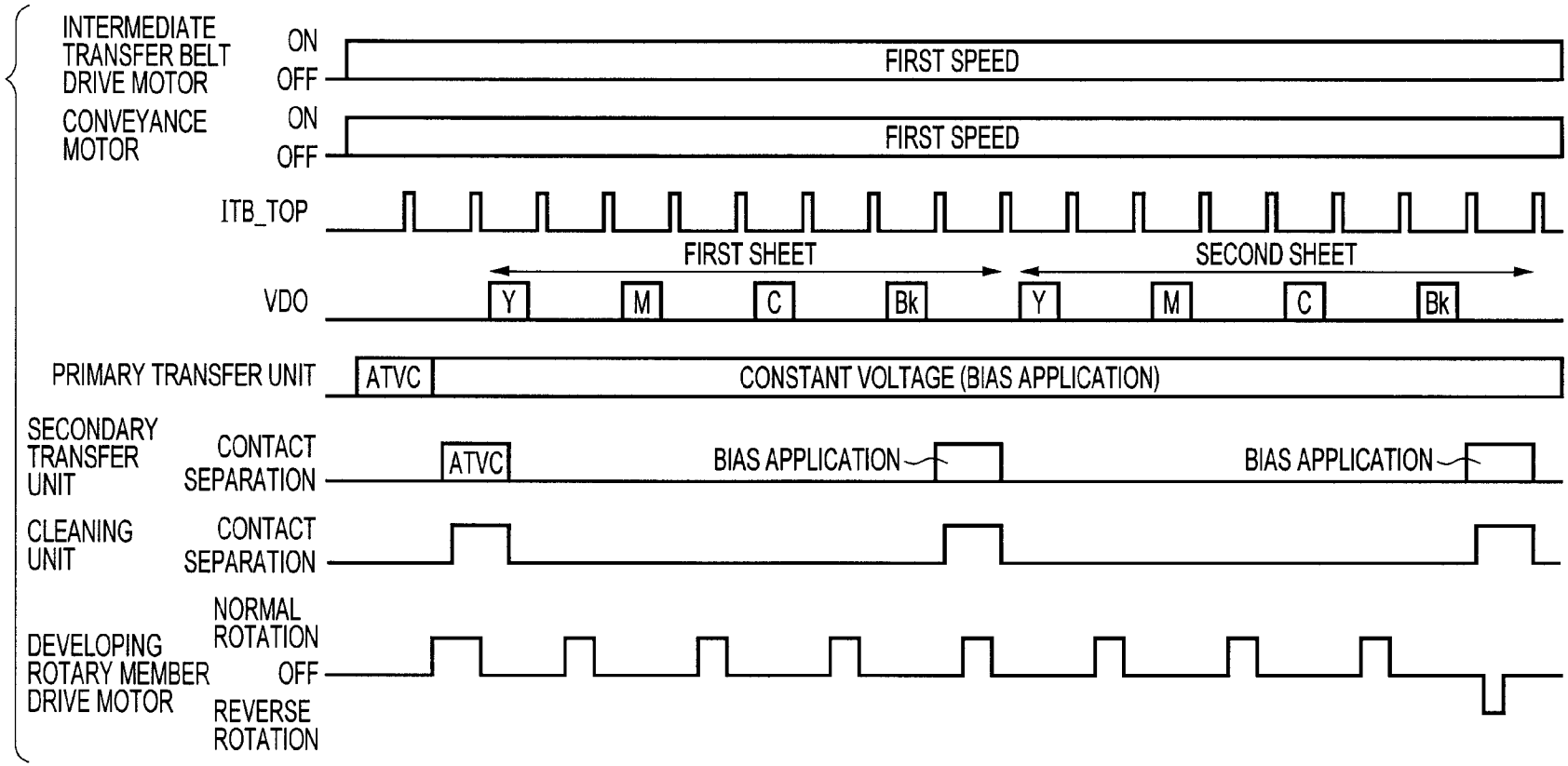
FIG. 4A and FIG. 4B are timing charts when performing full-color image forming at respective image forming speeds according to Embodiment 1.
Figure 4B:
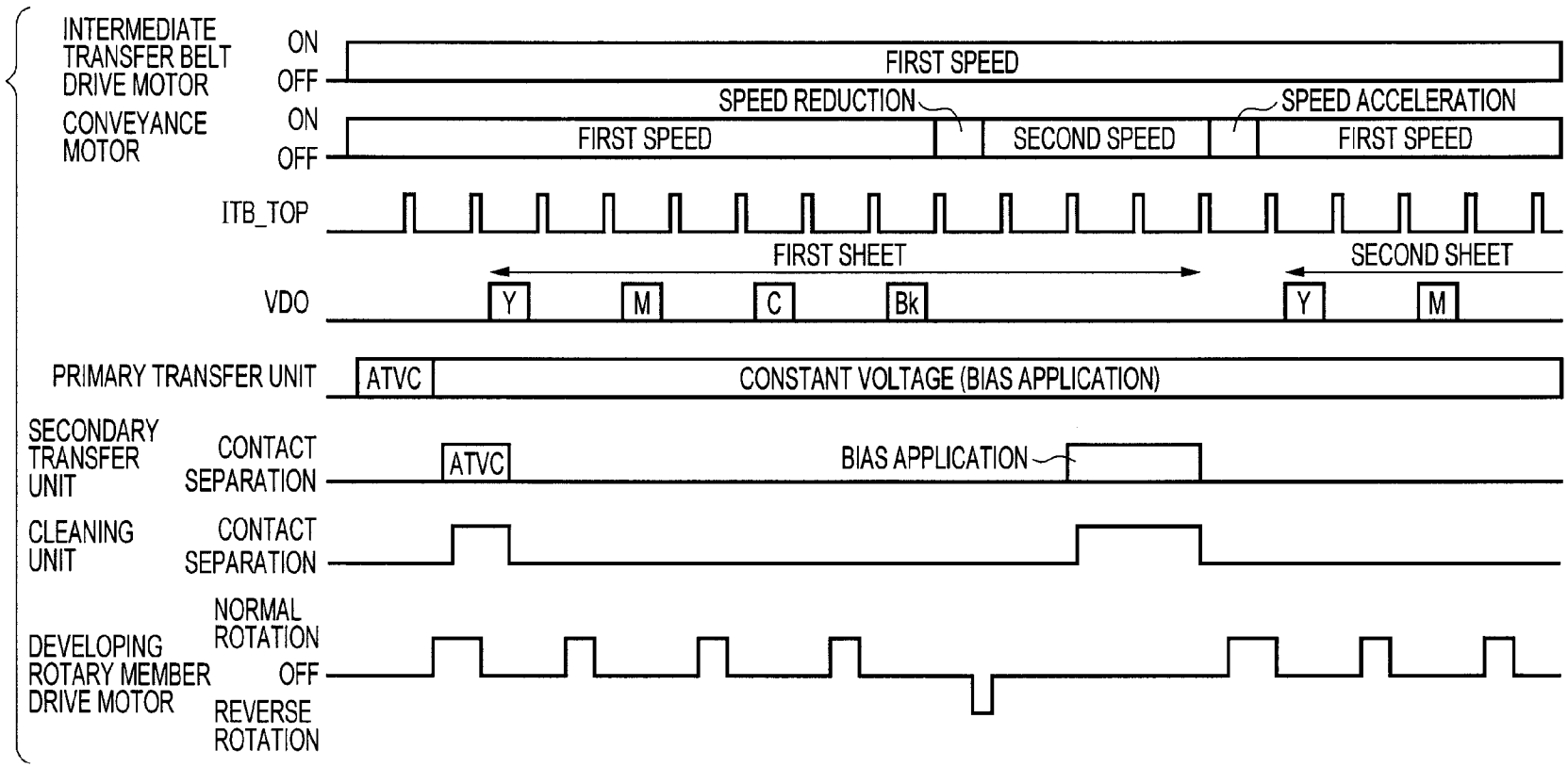
Figure 5:
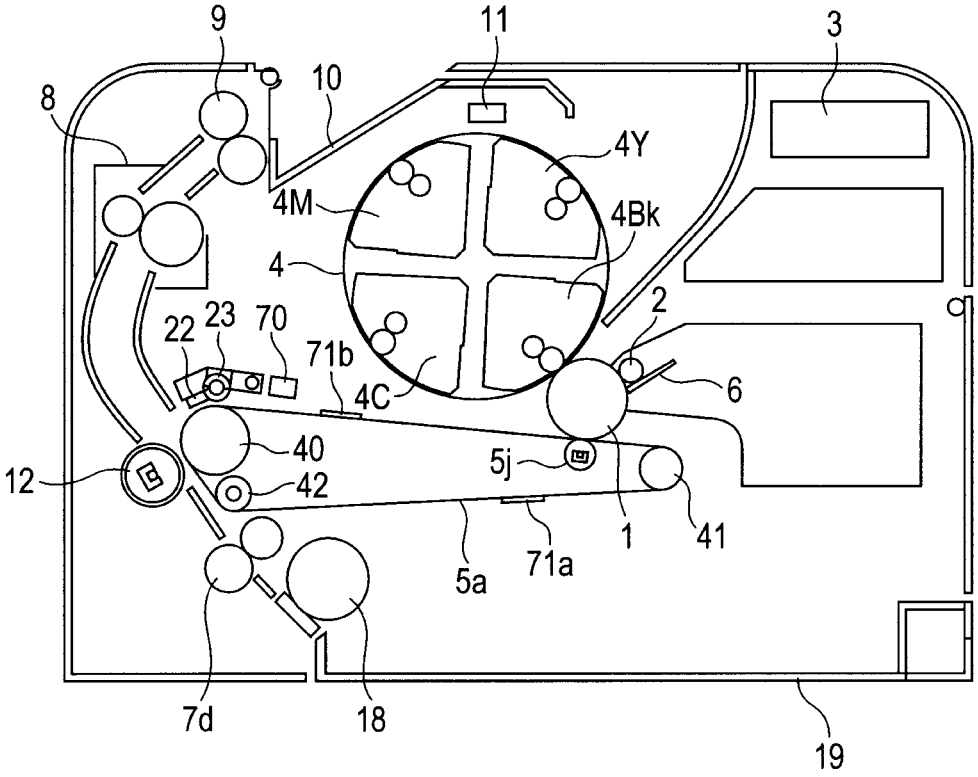
FIG. 5 is a view that illustrates the position of a developing device when starting printing of a second or subsequent sheet according to Embodiment 1.

Next, alignment of images at respective image forming speeds that is a feature of the present invention is described. FIG. 4A is a timing chart at the time of full-color image forming at a first image forming speed (described as "first speed" in the drawings). FIG. 4A illustrates a case where, for example, printing of two sheets is performed in a plain paper mode (first image forming mode). FIG. 4B is a timing chart when performing full-color image forming at a second image forming speed (described as "second speed" in the drawings). FIG. 1 illustrates a state of a rotary position (position of the developing devices of the rotary developing device 4) prior to printing with respect to both the first image forming speed and the second image forming speed. FIG. 5 illustrates a state of the rotary position at a time point when printing of a first sheet is completed and printing of a second sheet is starting at the first image forming speed. At the second image forming speed, printing starts from the state of the rotary position illustrated in FIG. 1, irrespective of the number of sheets that are printed. In this connection, the image forming apparatus of the present embodiment is operable at a plurality of image forming modes, and the term "first image forming speed" refers to, for example, an image forming speed when the image forming apparatus is in an image forming mode for plain paper. Further, the term "second image forming speed" refers to an image forming speed when the image forming apparatus is in an image forming mode for thick paper or glossy paper. The second image forming speed is, for example, a speed that is equivalent to 2/5 of the image forming speed when the image forming apparatus is in the image forming mode for plain paper. The reason the image forming speed differs depending on the image forming mode is that, for example, when the recording medium is thick paper or glossy paper, the fixability decreases in comparison to plain paper, and therefore the image forming speed is slowed down to improve the fixability.

FIG. 4A is a timing chart for a period from the start of printing until the end of printing when performing color printing of two sheets at the first image forming speed. The timing chart in FIG. 4A shows a timing at which a drive motor of the intermediate transfer belt 5*a* is turned on or off, a timing at which a conveyance motor of a paper conveyance section is turned on or off, and a timing at which the engine control section 200 detects an ITB_TOP signal, that relate to the color deviation correction (correction of alignment) of the present embodiment. FIG. 4A also shows a timing at which the engine I/F section 125 outputs a VDO signal. Further, FIG. 4A shows a timing for contact or separation as well as various operations of the cleaning unit, a primary transfer unit, and a secondary transfer unit, and drive timings (normal rotation, off, or reverse rotation) of a developing rotary member drive motor that drives the rotary developing device 4. Likewise, FIG. 4B is a timing chart for a period from the start of printing until the end of printing when performing color printing of two sheets at the second image forming speed. FIG. 4B illustrates, for example, a case of printing two sheets in a thick paper mode or a glossy paper mode (second image forming mode).

{Alignment of Toner Images of Each Color of a Full-Color Image when Printing a First Sheet at the First Image Forming Speed}

Figure 6A:
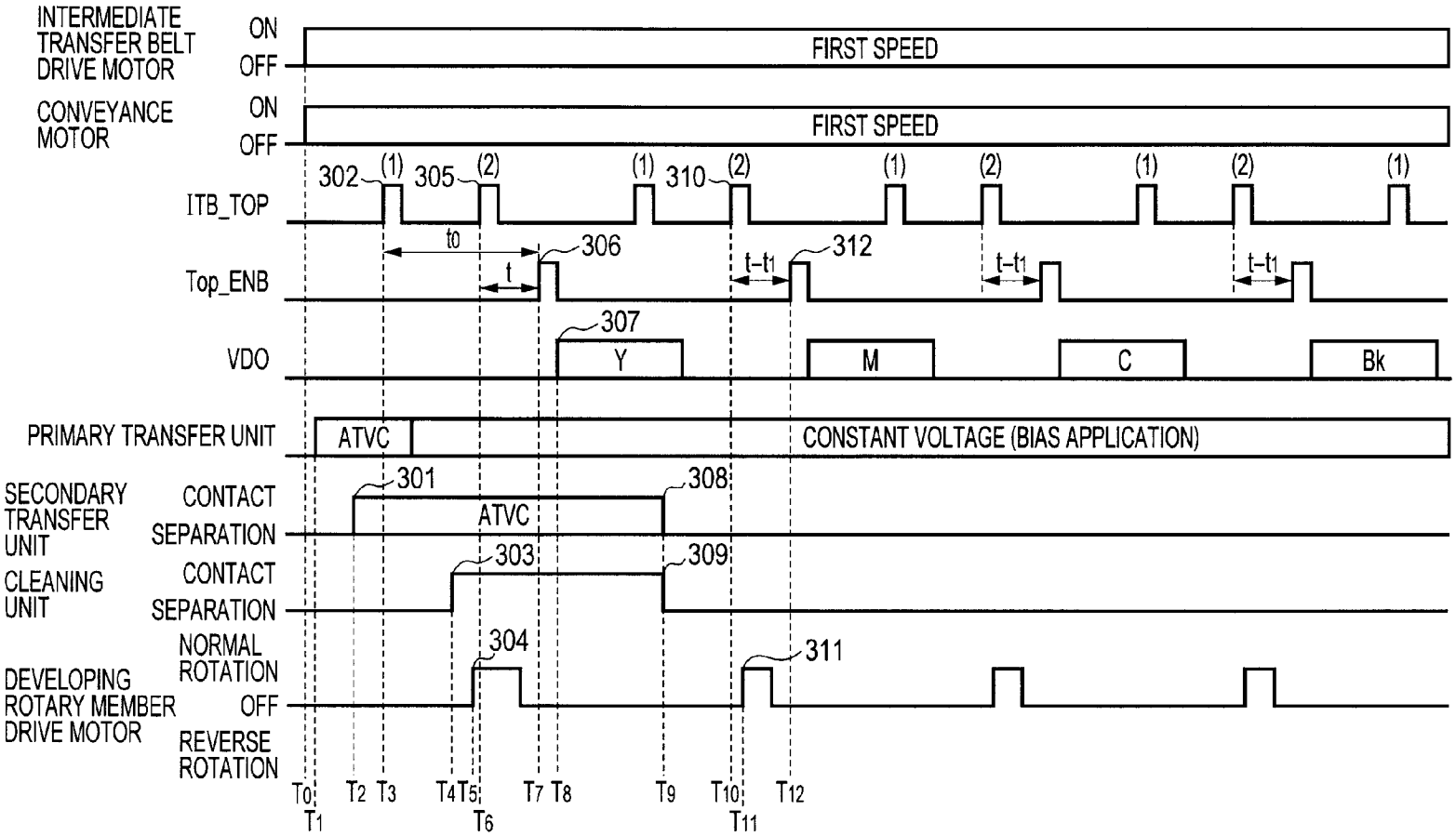
FIGS. 6A and 6B are timing charts when printing a first sheet and a second or subsequent sheet at a first image forming speed according to Embodiment 1.

A method of adjusting the alignment of toner images of each color when printing a first sheet at the first image forming speed, that is, the timing for starting to write image data, is described in detail below using FIG. 1 and FIG. 6A. The following description is based on the premise that toner images of a plurality of colors are formed. Further, hereafter, it is assumed that the engine control section 200, for example, controls the following control sequence using a counter. In this connection, a configuration may be adopted that, for example, uses a timer instead of a counter.

FIG. 4A will now be described in detail using FIGS. 6A and 6B. When a print job is input, the engine control section 200 starts the counter at $T_0$. Together with starting the counter, at $T_0$ the engine control section 200 also turns on an intermediate transfer belt drive motor to drive the drive roller 40 at the first image forming speed (first speed) and cause the intermediate transfer belt 5*a* to revolve. Further, at $T_0$ the engine control section 200 turns on the conveyance motor to also drive the conveyance rollers at the first image forming speed (first speed). The engine control section 200 refers to the counter that was started at $T_0$, and performs the following operations at a time point of a counter value $T_1$ (likewise, hereunder it is assumed that $T_n$ indicates a counter value). That is, at the time point $T_1$ the engine control section 200 makes the primary transfer roller 5*j* contact the intermediate transfer belt 5*a*. Thereafter, at $T_2$, the engine control section 200 causes the secondary transfer roller 12 (secondary transfer unit) as a process unit to contact the intermediate transfer belt 5*a* and detect the resistance of the intermediate transfer belt 5*a* (perform Active Transfer Voltage Control (ATCV) (301). When an electric current is applied to the secondary transfer roller 12 at the time of actual image forming, the electric current is varied according to the environment and the type of recording paper. The detected resistance value is used when the CPU 121 calculates the voltage at which to apply the secondary transfer bias at that time. In this connection, the ATVC control that the engine control section 200 performs with respect to the primary transfer unit is constant current control that is control for determining a voltage value when performing a primary transfer operation, and the ATVC control that the engine control section 200 performs with respect to the secondary transfer unit is constant current control that is control for determining a current value when performing a secondary transfer operation.

When the photosensor 70 detects the marker 71*a* on the intermediate transfer belt 5*a* as the result of rotation of the intermediate transfer belt 5*a*, the photosensor 70 outputs an ITB_TOP signal to the engine control section 200. In this connection, in the drawings, a circled number 1 denotes an ITB_TOP signal that the photosensor 70 outputs upon detecting the marker 71*a* (mark), and a circled number 2 denotes an ITB_TOP signal that the photosensor 70 outputs upon detecting the marker 71*b*. At $T_3$, the engine control section 200 detects the marker 71*a* that is a first reflective member by means of the photosensor 70, and thereby clarifies the position of the intermediate transfer belt 5*a* (302). In order to quickly determine the position of the intermediate transfer belt 5*a* and shorten the start-up time, it is necessary for the engine control section 200 to perform the following operations by taking the marker 71*a* that is first detected (at $T_3$) as a reference. The engine control section 200 sets the time when the ITB_TOP signal is detected as a reference time $T_3$, and based on the reference time $T_3$, at $T_4$ the engine control section 200 causes the cleaning unit as a process unit to contact intermediate transfer belt 5*a* to enter preparatory operations for image forming (303). Thereafter, at $T_5$, the engine control section 200 causes (normal rotation (clockwise rotation)) the developing rotary member drive motor of the rotary developing device 4 to rotate to thereby move the developing device 4Y for yellow as a process unit to the development position (304). The movement of this developing device represents contact control of a developing device, and such contact control is included in the preparatory operations for image forming. In this connection, as shown in FIG. 1, the starting position of the rotary developing device 4 is between the developing device 4C and the developing device 4Bk, and in order to cause the developing device 4Y to contact the photosensitive drum 1 it is necessary to make the developing device 4Bk pass by the photosensitive drum 1 (for example, in the case of a normal rotation, to rotate the rotary developing device 4 by 135 degrees). A mechanical shock occurs when the developing device 4Bk passes by the photosensitive drum 1. In this connection, two reasons why the starting position of the rotary developing device 4 is between the developing device 4C and the developing device 4Bk are as follows. One reason is that when a print job for black and white printing is input, the developing device Bk can be caused to immediately contact the photosensitive drum 1. Another reason is that the mechanical configuration of the development coupling on the developing device side and the development coupling on the main unit side is such that the development couplings do not engage (couple) with adequate positional accuracy at a time of reverse rotation.

Subsequently, when one part of the preparatory operations (preparatory operation up to contact of the cleaning unit) is completed, the engine control section 200 detects the marker 71*b* as a second reflective member by means of the photosensor 70, and sets $T_6$ that is the time of detection as a Y writing start reference time (305). Thereafter, the engine control section 200 is caused to stand by for a time period of a Y exposure starting time $t_0$ that is previously set to be longer than the interval from the Y writing start reference time $T_6$ to the reference time $T_3$. Further, at $T_7$ that is set to coincide with the Y exposure starting time $t_0$, the engine control section 200 outputs a Top_ENB signal to the video controller 102 to start an exposure operation (306). At this time, the engine control section 200 stores a time period from the Y writing start reference time $T_6$ until the time $T_7$ at which the engine control section 200 outputs the Top_ENB signal in the RAM 123 as an exposure synchronization time t.

Thereafter, at a VDO writing start (Y) time $T_8$ that takes the Top_ENB signal ($T_7$) as a reference point, the engine I/F section 125 outputs a VDO signal for yellow image forming (307). The engine control section 200 starts image forming based on the VDO signal that the engine I/F section 125 outputs. The engine control section 200 develops an electrostatic latent image on the photosensitive drum 1 with yellow toner by means of the rotary developing device 4, and transfers the toner image to the intermediate transfer belt 5*a* by means of the primary transfer roller 5*j*. Upon detecting the marker 71*a* once more, the engine control section 200 moves to the subsequent image forming process for a magenta image. At a predetermined time $T_9$ during the interval from a time when the marker 71*a* is detected until the marker 71*b* is detected, the engine control section 200 separates the secondary transfer roller 12, the charging brush 22 and the charging roller 23 for cleaning from the intermediate transfer belt 5*a* (308, 309). Thereby, the engine control section 200 prevents the secondary transfer roller 12, the charging brush 22 and the charging roller 23 from contacting the yellow image on the intermediate transfer belt 5*a*.

After a time $T_{10}$ (310) at which the marker 71*b* is detected, at $T_{11}$, the engine control section 200 drives the rotary developing device 4 to contact the developing device 4M for magenta with the photosensitive drum 1 (311). Specifically, in the contact control of the developing device at $T_{11}$, first the developing device 4Y for yellow is separated from a state of contact with the photosensitive drum 1, and thereafter the developing device 4M for magenta is caused to contact the photosensitive drum 1. Thus, the contact control includes both contact and separation.

Here, for example, a time (time required to rotate the rotary developing device 4 by 90 degrees) required to rotate (normal rotation) the rotary developing device 4 from a position at which the developing device 4Y contacts the photosensitive drum 1 to a position at which the developing device 4M contacts the photosensitive drum 1 (normal rotation from 311) is shorter than a time required for the rotation at $T_5$ from the starting position to the position at which the developing device 4Y contacts the photosensitive drum 1 (normal rotation from 304). The number of mechanical shocks that arise during the rotation from the position at which the developing device 4Y contacts the photosensitive drum 1 to the position at which the developing device 4M contacts the photosensitive drum 1 is also one less than the number of mechanical shocks that arise during the rotation from the starting position to the position at which the developing device 4Y contacts the photosensitive drum 1. Hence, the load is lighter, and consequently the intermediate transfer belt 5*a* moves faster when forming a toner image of magenta and the subsequent colors in comparison to when forming the toner image of yellow. More specifically, according to the present embodiment, a drive source that rotates the rotary developing device 4 and a drive source that rotates the intermediate transfer belt 5*a* are shared, and a sudden increase in the load for rotating the developing devices leads to a sudden increase in the load of the overall drive source. There is a limit to the ability of control to track a sudden increase in the load, and consequently the speed of the intermediate transfer belt 5*a* momentarily decreases. That is, when an increase in the load for rotating the developing devices is reduced by one time for coupling and withdrawal, respectively, the number of times that the speed momentarily decreases is reduced. As a result, the intermediate transfer belt 5*a* moves comparatively quickly compared to when there is a large number of sudden load increases. Consequently, it is necessary for the engine control section 200 to correct the timing for output of the Top_ENB signal for formation of toner images for magenta and the subsequent colors. The engine control section 200 starts an image forming sequence in a similar manner to when forming the yellow image (312) after a time period t–t1 ($T_{12}$) that is calculated by subtracting a color deviation correction amount t1 for the position shown in FIG. 1 from the exposure synchronization time t that was set at the time of yellow printing (first registration control corresponding to image forming of a first sheet).

By determining the exposure timing in this manner, it is possible to set an image writing start position in a region (exposure synchronization time t) in which there is no mechanical shock due to contact or separation of the secondary transfer roller 12, the charging brush 22, or the charging roller 23. If the image writing start position is in a region in which there is no mechanical shock, the intermediate transfer belt 5*a* can travel relatively stably, and therefore a color deviation caused by a circumferential speed fluctuation of the intermediate transfer belt 5*a* can be suppressed to a minimum. The four colors are superposed by determining image writing start positions based on the exposure synchronization time from the marker 71*b* with respect to cyan and black also, similarly to magenta, and the secondary transfer roller 12 is caused to contact the intermediate transfer belt 5*a* to perform secondary transfer of the toner images onto the recording medium.

{Alignment of Toner Images of Each Color of Full-Color Image when Printing Second and Subsequent Sheets at First Image Forming Speed}

Figure 6B:
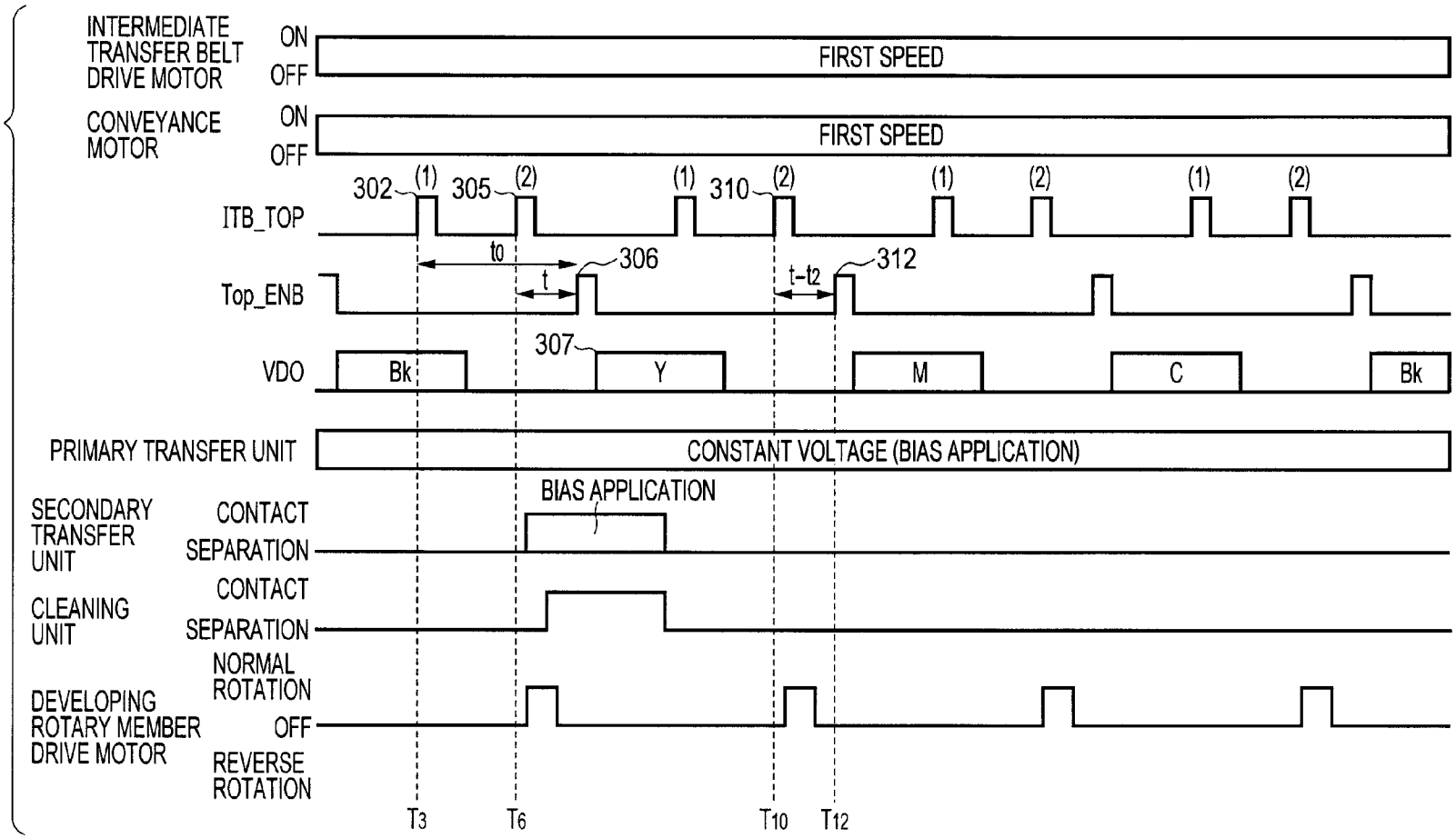

Next, the manner in which the toner images of each color are aligned when printing a second or subsequent sheet at a first image forming speed is described using FIG. 5 and FIG. 6B. FIG. 5 is a sectional view of the main body of the color image forming apparatus at a time point at which printing of the first sheet is completed. FIG. 6B is a timing chart of color deviation correction control at that time. The details of operations other than operations to determine a correction value are the same as for correction control in the state shown in FIG. 1 that is described above using FIG. 6A, and hence a description thereof is omitted hereunder.

The engine control section 200 performs the present correction upon determining that the developing device 4Bk for black of the rotary developing device 4 is in a state of contact with the photosensitive drum 1, based on a signal from the rotary position detecting sensor 11. Similarly to the control described in FIG. 6A, the engine control section 200 performs yellow image forming and sets the exposure synchronization time t. Thereafter, when image forming for magenta is performed, the engine control section 200 takes, as the exposure correction time, a value obtained by subtracting a color deviation correction amount t2 for the position shown in FIG. 5 from the exposure synchronization time t. The amount t2 is a smaller value than t1. Subsequently, after a time period t–t2 ($T_{12}$) following a time $T_{10}$ (310) at which the marker 71*b* is detected, the engine control section 200 starts an image forming sequence for magenta in a similar manner to when forming the yellow image (312) (second registration control corresponding to image forming of a second or subsequent sheet).

The correction contents will now be described. In the image forming apparatus of the present embodiment, this correction is performed because, from the state shown in FIG.

5 (that is, image forming for a second or subsequent sheet), the number of times coupling occurs between the developing device 4Bk for black and the photosensitive drum 1 until the developing device 4Y for yellow contacts the photosensitive drum 1 is reduced by one in comparison to the state shown in FIG. 1 (that is, image forming for a first sheet). The fact that contact of the developing device 4Bk for black is reduced by one time means that the number of times in which a load arises due to coupling an unshown development coupling with the developing device 4Bk is reduced by one time. Hence, compared to the time of $T_5$ to $T_7$ shown in FIG. 6A, the intermediate transfer belt 5*a* moves faster and the writing start position for yellow advances more than when the apparatus is in the state shown in FIG. 1. Therefore, the engine control section 200 subtracts a correction value from the exposure synchronization time for magenta and the subsequent colors, and also advances the writing start position for magenta and the subsequent colors (makes the output timing of the Top_ENB signal earlier), to thereby synchronize yellow and the colors other than yellow.

{Alignment of Toner Images of Each Color of Full-Color Image at Second Image Forming Speed}

Figure 7A:
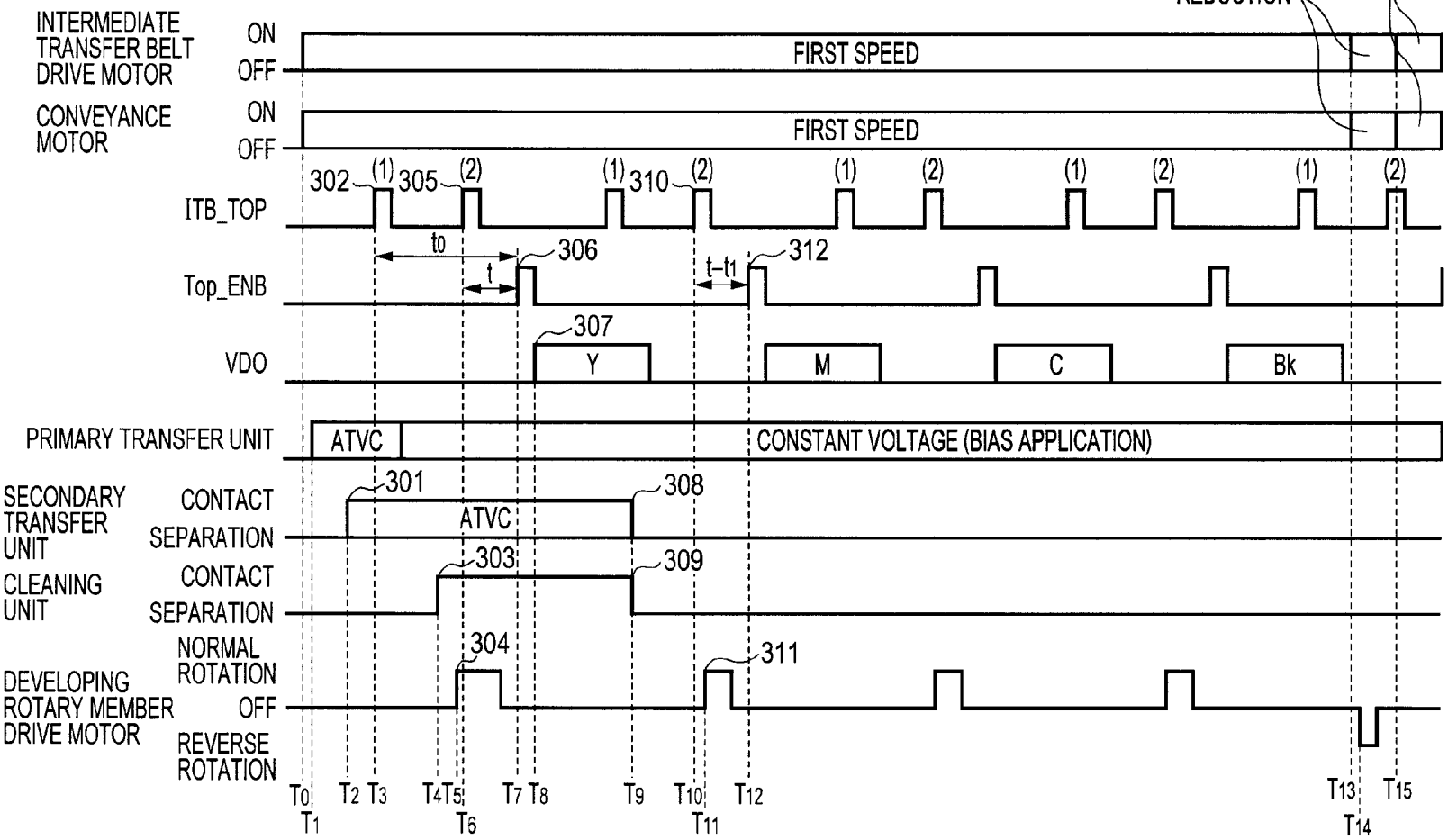
FIGS. 7A and 7B are timing charts when printing a first sheet and a second or subsequent sheet at a second image forming speed according to Embodiment 1.
Figure 7B:
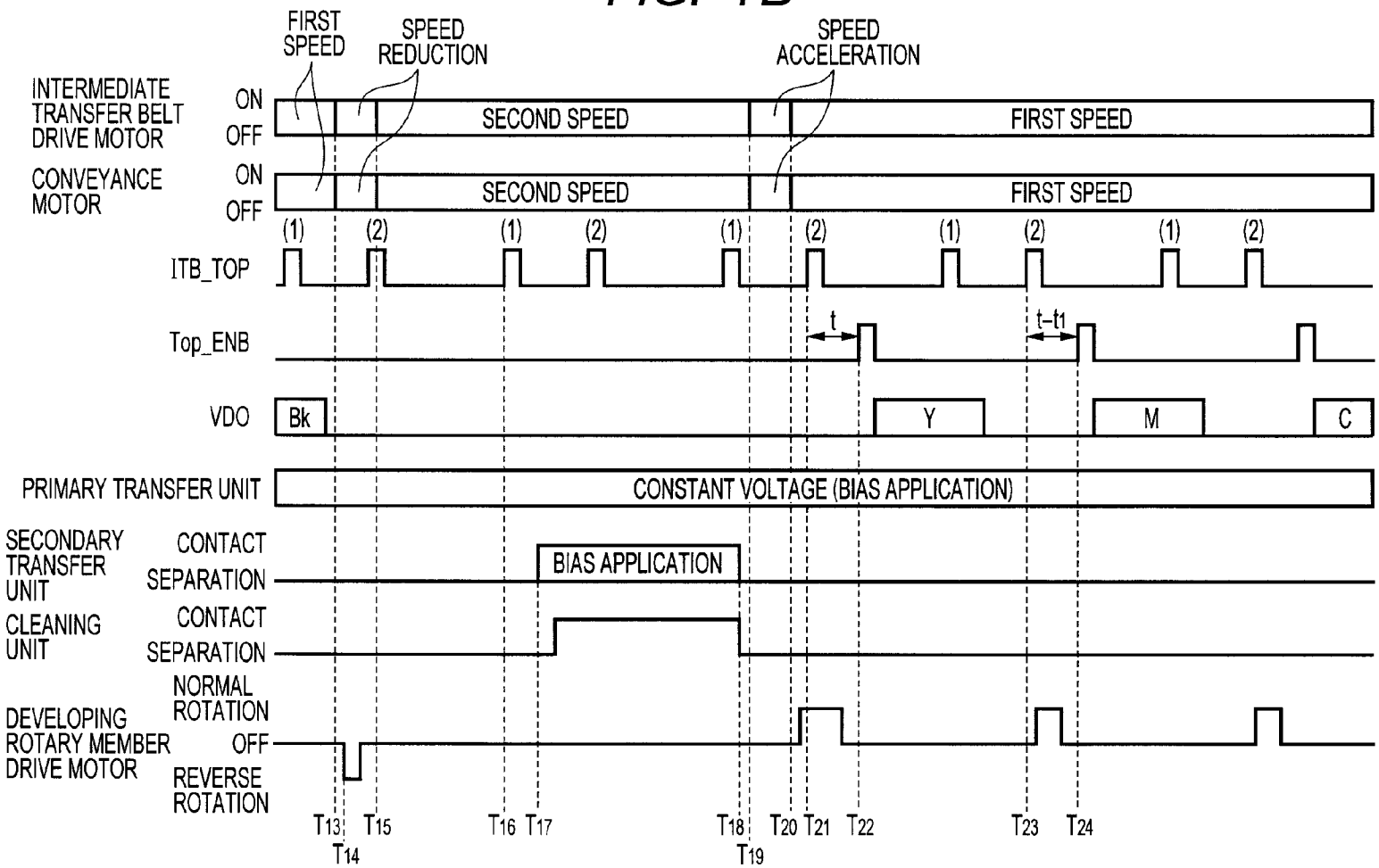

Next, the manner of aligning the toner images of each color at the second image forming speed is described using FIG. 1 and FIGS. 7A and 7B. FIG. 4B is described hereafter in detail referring to FIGS. 7A and 7B. According to the present embodiment, at the second image forming speed, the speed of secondary transfer and fixing operations are slowed down by conveying a sheet more slowly than when operating at the first image forming speed. However, the traveling speed of the intermediate transfer belt 5*a* is the same at the first image forming speed and the second image forming speed. More specifically, the primary transfer speed is the same.

In FIG. 7A, when the counter is $T_0$ the engine control section 200 turns on the intermediate transfer belt drive motor to drive the drive roller 40 and cause the intermediate transfer belt 5*a* to revolve. During the period from $T_0$ to $T_{12}$, the operations performed by the engine control section 200 are the same as for the correction when printing the first sheet at the first image forming speed as illustrated in FIG. 6A, and hence a description thereof is omitted. Up to $T_{12}$, the engine control section 200 executes image forming operations by causing the conveyance motor and the intermediate transfer belt drive motor to revolve at the first image forming speed. Thereafter, at a predetermined timing $T_{13}$ after finishing development of a black toner image, the engine control section 200 starts an operation to reduce the speed of the conveyance motor and the intermediate transfer belt drive motor. Together with these speed reductions, at a timing $T_{14}$, the engine control section 200 causes the developing rotary member drive motor to perform a reverse rotation to move the rotary developing device 4 to the rotary position illustrated in FIG. 1.

Subsequently, at a timing $T_{15}$, the engine control section 200 completes the operation to reduce the speed of the conveyance motor and the intermediate transfer belt drive motor and thereby changes the revolving speeds thereof to the second image forming speed. In this connection, the reason the engine control section 200 causes the developing rotary member drive motor to rotate in reverse at the timing of $T_{14}$ is as follows. As shown by the timing chart in FIG. 7B, at the second image forming speed (for example, a speed that is 2/5 of the first image forming speed), when performing the secondary transfer there is a greater interval between sheets than in the case of the timing chart for the 1/1 speed that is shown in FIG. 6B. During that interval, if a developing device of the rotary developing device 4 is brought into contact with the photosensitive drum 1 it will be disadvantageous with respect to the life of both the photosensitive drum and the developing roller, and hence it is necessary to move the developing devices to a position at which the developing devices do not contact the photosensitive drum 1. Further, in this case, in order to be able to respond promptly irrespective of whether the contents of the next job is black and white printing or color printing, the developing devices of the rotary developing device 4 are stopped/made to standby at the position to which the rotary developing device 4 is moved after the developing rotary member drive motor has been caused to rotate in reverse, that is, the state shown in FIG. 1.

Further, as described above, if the development coupling on the developing device side and the development coupling on the main unit side, to which the coupling on the developing device side is linked, engage together (couple) with adequate positional accuracy even at a time of reverse rotation of the rotary developing device 4, a configuration may be adopted in which the developing rotary member drive motor is caused to perform a normal rotation by the same amount at the timing of $T_{14}$. In this case, the number of times a mechanical shock occurs will be less than the number of times a mechanical shock occurs in the case illustrated in FIG. 7B. Accordingly, the value of t1 that is used for (t−t1) that is shown in FIG. 7B may be changed to a value that corresponds to a single mechanical shock.

Next, operations at the second image forming speed from secondary transfer of an image onto a first sheet up to the start of image forming for a second sheet and thereafter are described using FIG. 7B. Timings $T_{13}$, $T_{14}$, and $T_{15}$ in FIG. 7B represent the same timings as in FIG. 7A, respectively. At $T_{15}$, after the respective drive speeds have been changed to the second image forming speed, taking a timing $T_{16}$ at which the marker 71*a* is detected as a reference, at a time point of $T_{17}$ the engine control section 200 causes the secondary transfer unit to contact the intermediate transfer belt 5*a* and apply a bias thereto to start a secondary transfer. Subsequently, taking a timing $T_{18}$ at which transfer of the toner images on the intermediate transfer belt 5*a* onto the recording medium ends as a reference, at a timing $T_{19}$ the engine control section 200 starts to increase the speed of the conveyance motor and the intermediate transfer belt drive motor. Thereafter, at a timing $T_{20}$, the engine control section 200 completes the operation to change the speed of the conveyance motor and the intermediate transfer belt drive motor to the first image forming speed.

Next, taking a timing $T_{21}$ at which the marker 71*b* is detected as a reference, the engine control section 200 executes an image forming operation in the same manner as for the first sheet. In this case, since the engine control section 200 causes the developing rotary member drive motor to rotate in reverse at the timing $T_{14}$ in FIG. 7A and FIG. 7B, the position of the rotary developing device 4 moves to the position shown in FIG. 1. Therefore, the rotational amount of the rotary developing device 4 before starting exposure of a Y toner image for a second or subsequent sheet is the same as when starting exposure of a Y toner image for the first sheet. More specifically, when performing secondary transfer or fixing at the second image forming speed that is different from the first image forming speed, such as when in an image forming mode for printing on thick paper or glossy paper, the engine control section 200 sets the color deviation correction amount for the second or subsequent sheet to the value t1 that is the same value as for the first sheet. The engine control section 200 outputs a Top_ENB signal for yellow at a timing $T_{22}$ that occurs at a time point that is the amount of the exposure synchronization time t after the timing $T_{21}$ at which the marker 71*b* is detected. Subsequently, the engine control section 200 outputs a Top_ENB signal for magenta at a timing $T_{24}$ that is the amount of t–t1 after a timing $T_{23}$ at which the marker 71*b* is detected. The correction control during the period from the timing $T_{23}$ to $T_{24}$ is second registration control that corresponds to image forming for a second or subsequent sheet. The value for t1 at this time is a correction amount for the first registration control that corresponds to image forming for a second or subsequent sheet. Thus, the engine control section 200 causes the image forming operations for magenta and the subsequent colors to start after a time period t–t1 obtained by subtracting the color deviation correction amount t1 for the position illustrated in FIG. 1 from the exposure synchronization time t that is set when printing a yellow toner image.

As described above, according to the present embodiment, it is possible to appropriately correct an exposure timing for each image forming speed in accordance with which page of a print job image forming is being performed for. As a result, a rotary-type full-color image forming apparatus can be provided which suppresses a color deviation among toner images of each color to a minimum. More specifically, according to the present embodiment, while achieving miniaturization of the apparatus and a short wait time, registration control that corresponds to a plurality of image forming modes can be performed when printing a plurality of pages.

Embodiment 2

Figures 8A, 8B:
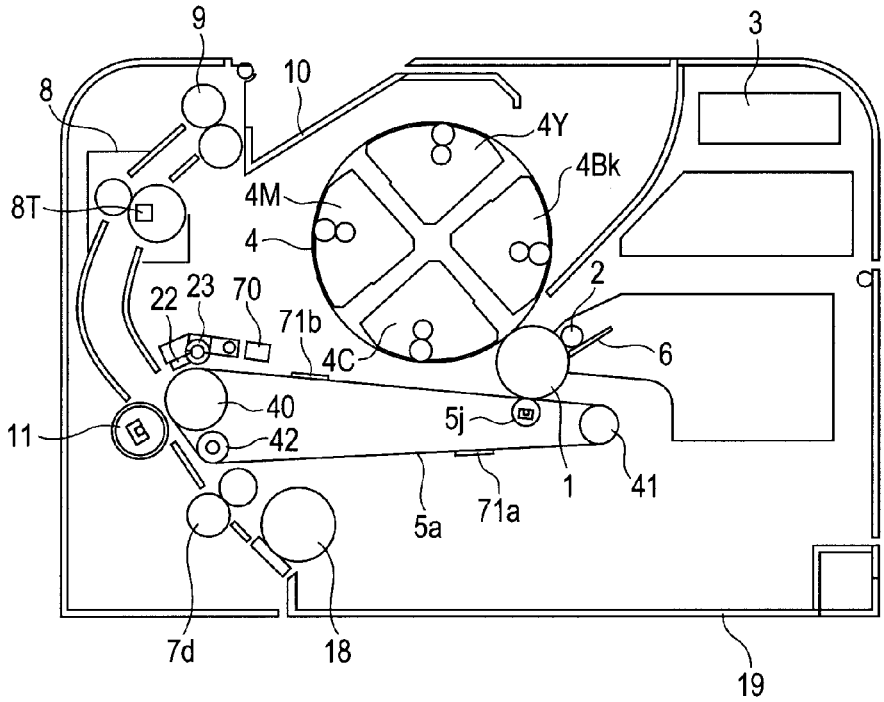
FIG. 8A is a sectional view that illustrates an image forming apparatus including a thermistor according to Embodiment 2.
FIG. 8B is a table that is used to select a color deviation correction time.

Embodiment 2 is described hereafter using FIGS. 8A and 8B. FIG. 8A is a main sectional view of an image forming apparatus according to the present embodiment. In addition to having the configuration of the image forming apparatus according to Embodiment 1, the image forming apparatus of the present embodiment determines color deviation correction amounts t1 and t2 by taking into consideration a result of detecting the resistance of the intermediate transfer belt 5*a* as well as the warm-up state of the fixing device 8. Therefore, the image forming apparatus of the present embodiment includes a thermistor 8T for detecting the temperature of the fixing device 8. The thermistor 8T is provided in the vicinity of the fixing device 8.

{Primary Transfer Bias Detection}

After the start of printing, the engine control section 200 of the image forming apparatus determines the optimal primary transfer bias for the time of a primary transfer. More specifically, the engine control section 200 executes control so that a current flowing to a primary transfer portion is constant. Further, the engine control section 200 stores the value of a voltage that a primary transfer high-voltage power source (not shown) outputs when constant current control is performed in the RAM 123 (hereunder, this series of control operations is referred to as "ATVC"). In this connection, although voltage values are stored in the ATVC results shown in the table in FIG. 8B, ultimately the voltage value corresponds to the resistance value of the intermediate transfer belt 5*a*. That is, a correction amount stored in the table shown in FIG. 8B corresponds to a correction amount that is in accordance with the resistance value of the intermediate transfer belt 5*a*. Thus, when actually executing primary transfer of a toner image onto the intermediate transfer belt 5*a*, the engine control section 200 can apply the optimal primary transfer bias in accordance with the resistance value of the intermediate transfer belt 5*a*, and as a result can obtain a favorable image. Further, it is known that a dynamic friction force that is generated at the primary transfer nip part differs according to the voltage of the primary transfer bias. More specifically, the higher that the primary transfer bias voltage is, the higher that the dynamic friction force becomes. Conversely, the lower that the primary transfer bias voltage is, the lower that the dynamic friction force becomes. Here, a configuration may be adopted in which the engine control section 200 can detect a resistance value of the intermediate transfer belt 5*a* in accordance with a voltage value of the ATVC result that is described above, and perform control so as to apply a voltage based on the detected resistance value of the intermediate transfer belt 5*a*. For example, when the primary transfer speed is changed, the engine control section 200 can recalculate the primary transfer bias based on the determined resistance value.

{Detection of Warm-Up State (Warming-Up Status) of Fixing Device}

In the fixing control when printing on a recording medium, the engine control section 200 controls so as to heat a heater (unshown) that is provided inside the fixing device 8, and determines the warming-up status of the fixing device 8 according to a temperature detected by the thermistor 8T. More specifically, the engine control section 200 determines the color deviation correction amounts t1 and t2 according to the primary transfer bias that is the resistance value measurement result of the primary transfer portion and the warming-up status that the image forming apparatus detects based on the temperature detected by the thermistor 8T.

Figure 9:
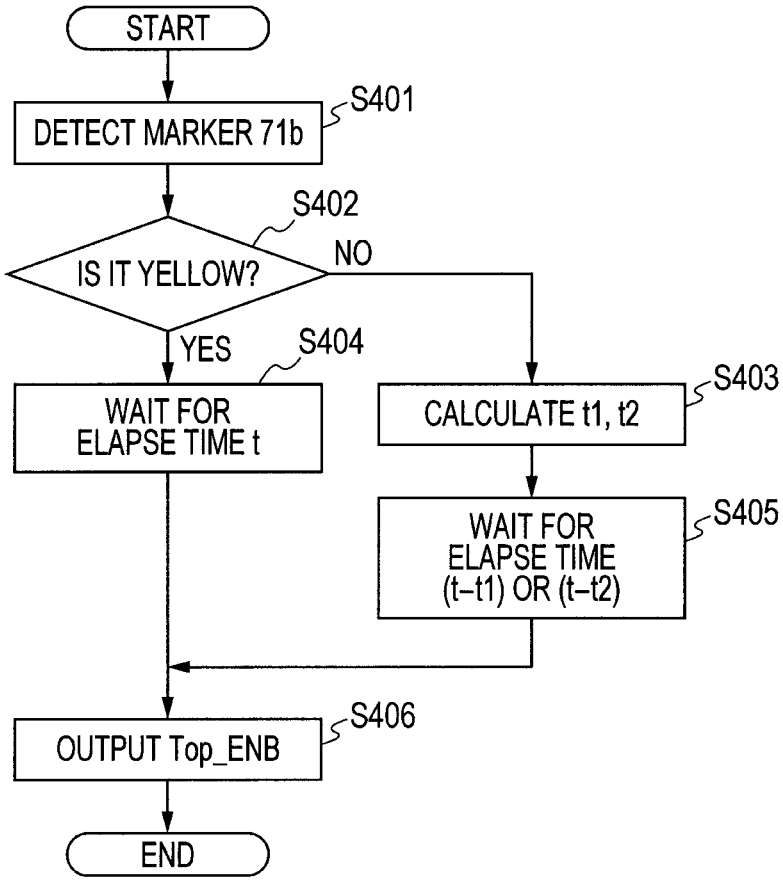
FIG. 9 is a flowchart of operations performed when selecting a color deviation correction time according to Embodiment 2.

Operations that the engine control section 200 performs when determining the color deviation correction amounts t1 and t2 are described next using the flowchart shown in FIG. 9. The engine control section 200 performs the processing shown in FIG. 9 each time the photosensor 70 detects the marker 71*b*. In step (hereunder, abbreviated as "S") 401, the engine control section 200 detects the marker 71*b* on the intermediate transfer belt 5*a* by means of the photosensor 70. In S402, the engine control section 200 determines whether or not a Top_ENB signal to be output next is a Top_ENB signal that serves as a basis for exposing a Y toner image (determines if the Top_ENB signal is for yellow). If the engine control section 200 determines in S402 that the Top_ENB signal to be output next is a Top_ENB signal that serves as a basis for exposing a Y toner image, in 5404 the engine control section 200 waits until a time t elapses. Note that the time t is the exposure synchronization time t that was described in Embodiment 1. In 5406, the engine control section 200 outputs the Top_ENB signal.

In contrast, if the engine control section 200 determines in S402 that the Top_ENB signal to be output next is not a Top_ENB signal that serves as a basis for exposing a Y toner image, in 5403 the engine control section 200 calculates values for the color deviation correction amounts t1 and t2 based on the ATVC results and the warming-up status. In 5405, the engine control section 200 waits for a time period that is determined in accordance with the image forming mode, i.e. what the image forming speed is, and with which the sheet (i.e. the first sheet or second or subsequent sheet) is being printed, after detecting the marker 71*b* in 5401. More specifically, the engine control section 200 waits for a time t–t1 to elapse when printing the first sheet at the first image forming speed (FIG. 6A) or when printing all the sheets at the second image forming speed (FIG. 7A and FIG. 7B). The engine control section 200 waits for a time t–t2 to elapse when printing the second and subsequent sheets at the first image forming speed (FIG. 6B). In this connection, here, t1 is the color deviation correction amount t1 when rotating the developing devices from the state shown in FIG. 1 that is described according to Embodiment 1. Further, t2 is the color deviation correction amount t2 when rotating the developing devices from the state shown in FIG. 5 that is described according to Embodiment 1.

In S403, the engine control section 200 determines the color deviation correction amounts t1 and t2 based on the table shown in FIG. 8B. Specifically, for example, hereunder a case is assumed in which the warming-up status (environment) of the fixing device 8 that is determined based on the detection result of the thermistor 8T is warming-up status b, the ATVC result is V1 (thus corresponding to V1*b* in the table), the image forming speed is the first image forming speed, a first sheet is being printed, and the color to be exposed next is magenta. In this case, in 5403, the engine control section 200 sets t1=t1(M1*b*) according to the table in FIG. 8B. In this case, the reason the color deviation correction amounts t1 and t2 are varied according to which color is to be exposed next is, for example, to take into account an effect that is caused by the fact that the remaining quantity of toner differs according to the respective colors. In this connection, the table shown in FIG. 8B, for example, is previously stored in the nonvolatile memory section 124. Note that, although according to the present embodiment the engine control section 200 determines a color deviation correction amount based on both the warming-up status of the fixing device 8 and the ATVC result, the engine control section 200 may determine a color deviation correction amount based on at least either one of the warming-up status and the ATVC result. Further, according to the present embodiment, although the engine control section 200 determines a color deviation correction amount based on the warming-up status of the fixing device 8, the warming-up status of the fixing device 8 is one example of detecting an environmental condition of the image forming apparatus, and the present invention is not limited thereto. As a technique for detecting an environmental condition of the image forming apparatus, an environmental condition inside the image forming apparatus may be detected using a temperature detection sensor or a humidity detection sensor or the like that is installed inside the image forming apparatus. The engine control section 200 may also determine a color deviation correction amount based on an environmental condition that is detected in this manner.

As described in the foregoing, according to the present embodiment, a configuration is adopted that appropriately corrects a formation position of a toner image in accordance with each image forming speed, the number of printing sheets, the ATVC result, and the warming-up status of the fixing device 8. Thus, according to the present embodiment, a rotary-type full-color image forming apparatus can be provided which suppresses a color deviation among toner images of each color to a minimum. More specifically, according to the present embodiment, while achieving miniaturization of the apparatus and a short wait time, registration control that corresponds to a plurality of image forming modes can be performed when printing a plurality of pages.

Embodiment 3

[Alignment of Toner Image of Each Color of Multi-Color Image at First Rotary Position (FIG. 1)]

In Embodiment 3, a description of matters that are common to Embodiments 1 and 2 is omitted. According to the description relating to FIGS. 6A, 6B, 7A and 7B, a case was described in which color deviation correction control is performed based on a measurement result obtained by measuring the relationship between a reference time $T_5$ and a time from output of the ITB_TOP signal until an exposure standby time period $t_0$ elapses. However, the present invention is not limited to that form. Another embodiment that can obtain a similar correction result is illustrated in FIGS. 10A and 10B.

Figure 10A:
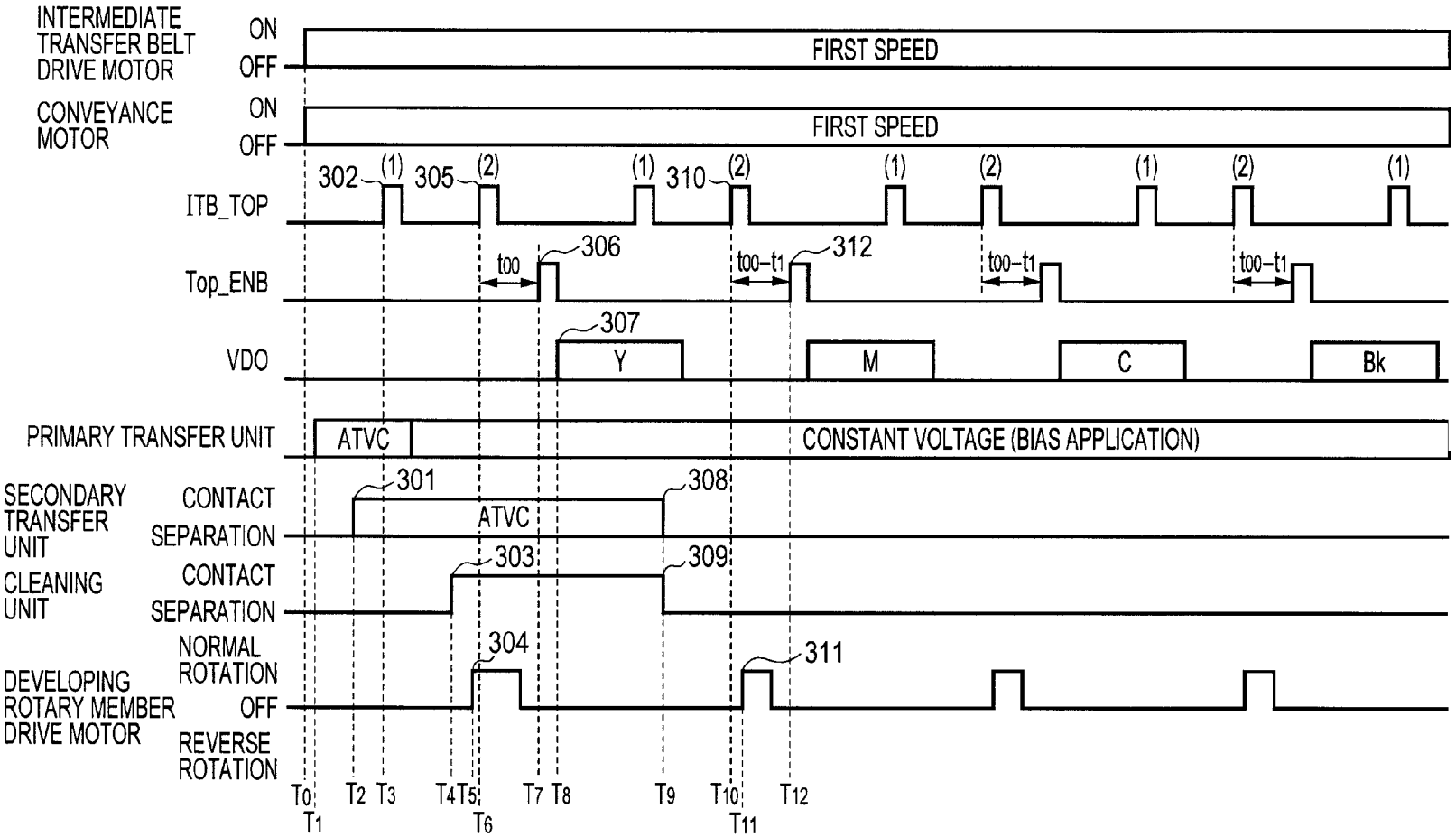
FIGS. 10A and 10B are timing charts when printing a first sheet and a second or subsequent sheet at a first image forming speed according to Embodiment 3.
Figure 10B:
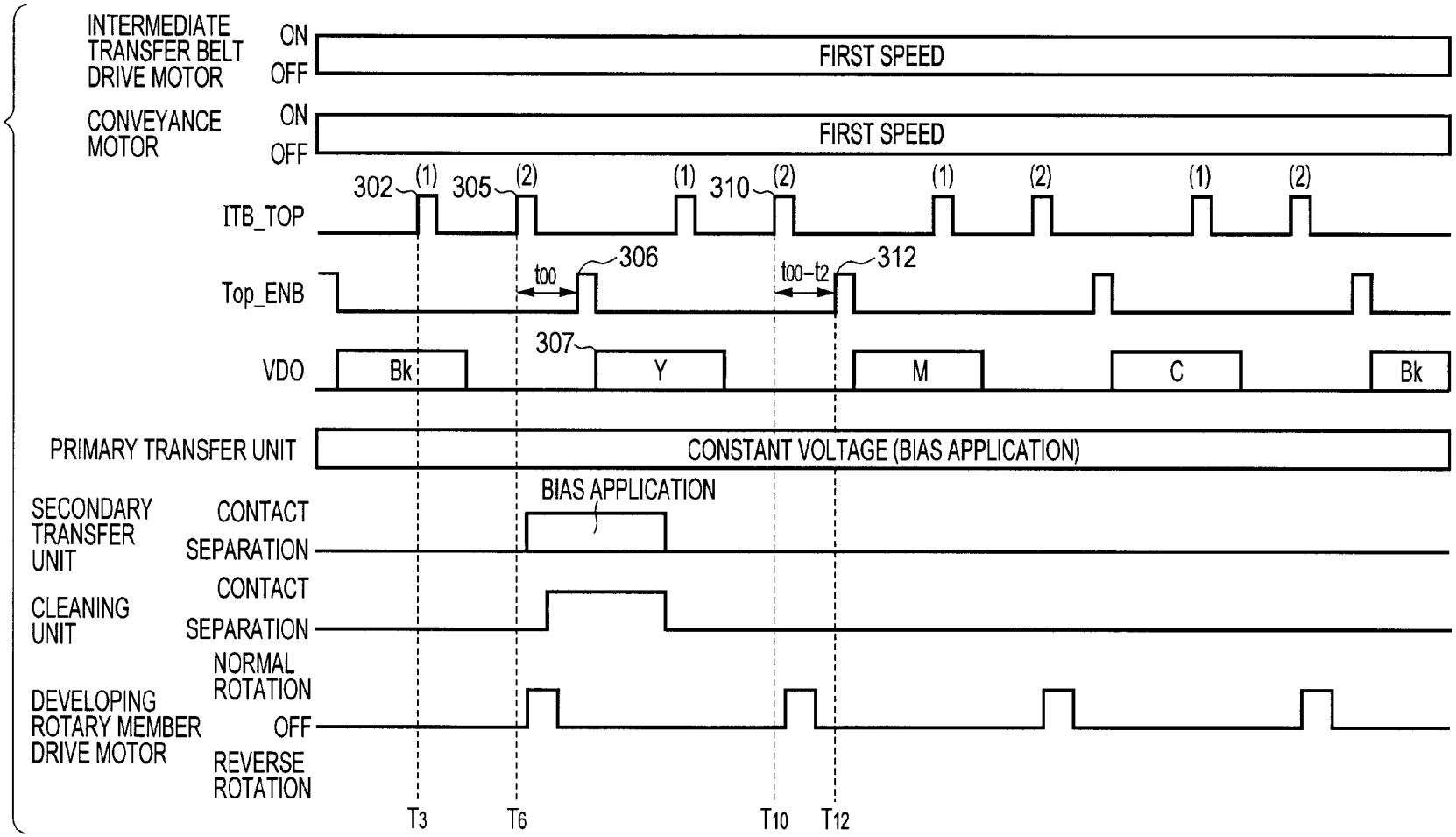

According to FIGS. 10A and 10B, the CPU 121 outputs a Top_ENB signal 305 after a time period $t_{00}$ has elapsed from a time $T_5$ at which the marker 71*b* is detected by the photosensor 70. Further, at a time $T_{12}$ after an exposure correction time $t_{00}-t_1$ has elapsed from a time $T_{10}$ at which the marker 71*b* is detected, the CPU 121 outputs a Top_ENB signal 312 for magenta to the exposure device 3. The CPU 121 also outputs the Top_ENB signal upon the elapse of the exposure correction time $t_{00}-t_1$ in a similar manner with respect to the other colors. Furthermore, with regard to stopping of the rotary developing device 4 illustrated in FIG. 5, a correction of $(t_{00}-t_2)$ may be performed with respect to the $(t_{00}-t_1)$ correction in FIGS. 10A and 10B. By adopting the configuration described above, it is possible to obtain the same advantages as in Embodiments 1 and 2.

Other Embodiments

According to the above embodiments, a configuration is adopted in which the exposure synchronization time t for yellow is fixed, and correction that takes into consideration the color deviation correction amount t1 or t2 is carried out with respect to magenta, cyan, and black. However, a configuration may be adopted in which an exposure synchronization time for magenta, cyan, and black is fixed, and correction that takes into consideration a color deviation correction amount is carried out with respect to yellow.

Further, in the foregoing embodiments, a case in which a correction value is subtracted or added is described with respect to correction of an exposure timing. However, for example, a configuration may be adopted in which positional correction is performed by multiplying or dividing a correction value. In that case, for example, a value that is multiplied or divided by t may be set as a correction value so as to obtain a similar value to $(t-t_1)$.

According to the above embodiments, color deviation correction control by the engine control section 200 is applied to a color image forming apparatus that performs a primary transfer onto the intermediate transfer belt 5*a* and performs a secondary transfer onto a recording medium at a secondary transfer portion. However, for example, the color deviation correction control can also be applied to a color image forming apparatus that, for each of a plurality of colors, repeatedly performs an operation to transfer a toner image formed on a photosensitive drum onto a recording medium that is conveyed by a conveyance member. In other words, instead of the above described intermediate transfer belt 5*a*, a conveyance member may be employed that conveys a recording medium onto which toner images are transferred. Further, at such time, the table described in FIG. 8B is a table in which the correction amounts t1 and t2 are made to correspond to the warming-up status of the fixing device 8 (environmental state of the image forming apparatus) and the resistance value of the recording medium (printing paper).

Further, according to the above embodiments, color deviation correction control is performed by controlling an exposure timing at which the exposure device 3 starts to expose the surface of the photosensitive drum 1. However, a configuration may be adopted in which speed control of the peripheral surface speed of the photosensitive drum 1 is performed so as to cancel out a color deviation and, as a result, correct the formation position of the toner image to be subjected to primary transfer.

Furthermore, according to the above description, an example was described in which the cleaning unit as a cleaning member is caused to contact the intermediate transfer belt 5*a* (a preparatory operation) in response to detection of the marker 71*a*. However, the present invention is not limited thereto, and a configuration may also be adopted that causes the secondary transfer unit to contact the intermediate transfer belt 5*a* in response to detection of the marker 71*a*. However, in that case, the correction value may be set to a value that takes into consideration a mechanical shock that is caused by contact of the secondary transfer unit.

In addition, according to the above description, an example was described in which, as an image forming preparatory operation, a process unit (cleaning unit or the like) is caused to contact (preparatory operation) the intermediate transfer belt 5*a* upon detecting the marker 71*a*. Here, for example, even in a case where the cleaning unit is separated from the intermediate transfer belt 5*a* during the period from the time $T_2$ to the time $T_5$ shown in FIGS. 7A and 7B, a mechanical shock occurs. Accordingly, the above described operations may be performed even when separation of the cleaning unit or the secondary transfer unit occurs during the interval from detection of the marker 71*a* to detection of the marker 71*b*. However, in such case, the correction value may be set to a value that takes into account the mechanical shock caused by the separation.

Further, in the foregoing description, the intermediate transfer belt 5*a* is described as a rotating member on which the markers 71*a* and 71*b* are formed. However, the present invention is not limited thereto. For example, a transfer-member bearing member that bears and rotates a recording material onto which a toner image undergoes primary transfer may be employed as a rotating member on which the markers 71*a* and 71*b* are formed.

Furthermore, in the foregoing description, an example was described in which a preparatory operation in which a process unit as defined above contacts or separates from the intermediate transfer belt 5*a* is executed upon detection of the marker 71*a*. However, for example, a configuration may also be adopted in which a preparatory operation for image forming is executed after a predetermined time period elapses from a time when rotation of the intermediate transfer belt 5*a* starts, and not based on detection of the marker 71*a*.

Thus, according to the other embodiments also, while achieving miniaturization of the apparatus and a short wait time, registration control that corresponds to a plurality of image forming modes can be performed when performing continuous printing of a plurality of pages.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-185566, filed Aug. 26, 2010, which is hereby incorporated by reference herein in its entirety.

What is claimed is:

1. A color image forming apparatus, comprising:

a photosensitive member;

a developing unit including a plurality of developing devices that develop electrostatic latent images formed on the photosensitive member with different color toners as a toner image;

an image bearing member for transferring a toner image formed on the photosensitive member, or a conveyance member that conveys a sheet onto which the toner image is transferred;

a control unit that performs a contact control in which one of the plurality of developing devices contacts with or separates from the photosensitive member and then an image formation after stand-by for a time period, wherein said color image forming apparatus is operable in a first image forming mode and in a second image forming mode, the contact control in the first image forming mode being different from the contact control in the second image forming mode, and wherein the control unit differentiates a correction amount for alignment in a registration control in the first image forming mode from a correction amount for alignment in the registration control in the second image forming mode.

2. A color image forming apparatus according to claim 1, further comprising a detection unit that detects a mark formed on the image bearing member or the conveyance member, wherein the contact control by the control unit is performed according to detection of the mark.

3. A color image forming apparatus according to claim 2, wherein the contact control includes a first contact control for a first image formation on a first sheet and a second contact control for a second image formation on successive sheets after the first sheet, wherein a timing in which the one of the plurality of developing devices contacts with or separates from the photosensitive member is different between the first and the second image formations, and wherein the control unit performs the first contact control for the first sheet and a registration of toner images for the first image formation, and the second contact control for successive sheets after the first sheet and another registration of toner images for the second image formation.

4. A color image forming apparatus, comprising:

a first process unit that includes a photosensitive member and an image bearing member for transferring a toner image formed on the photosensitive member, or a conveyance member that conveys a sheet onto which the toner image is transferred;

a detection section that detects a mark formed on the image bearing member or the conveyance member, wherein according to a detection of the mark by the detection section, said color image forming apparatus performs contact control in which the first process unit contacts with a second process unit, or the second process unit is separated from a state in which the second process unit contacts with the first process unit to form a toner image on the image bearing member or the sheet, and image forming after stand-by for a time period, and said color image forming apparatus repeatedly performs the contact control and the image forming for each of sheets; and a control section that, when an image forming for a first sheet is performed, performs the contact control for the second process unit and also performs first registration control that corresponds to image forming for the first sheet according to the detection of the mark by the detection section, and when an image forming for a second or subsequent sheets is performed, performs the contact control for the second process unit and also performs second registration control that corresponds to image forming for the second or subsequent sheets according to the detection of the mark by the detection section, wherein said color image forming apparatus is operable in a first image forming mode and in a second image forming mode in which a conveyance speed of a sheet when a toner image is fixed onto the sheet is different from a conveyance speed of a sheet in the first image forming mode, the contact control in the first image forming mode being different from the contact control in the second image forming mode, and the control section differentiates a correction amount for an alignment in the second registration control in the first image forming mode from a correction amount for alignment in the second registration control in the second image forming mode.

5. A color image forming apparatus according to claim 1, wherein the control section sets the correction amount according to a resistance value of the image bearing member or the conveyance member.

6. A color image forming apparatus according to claim 1, wherein the control section sets the correction amount according to an environmental condition of the color image forming apparatus.

7. A color image forming apparatus according to claim 1, wherein the control section varies the correction amount with respect to each of a plurality of colors.

8. A color image forming apparatus according to claim 1, wherein an image forming speed in the second image forming mode is slower than an image forming speed in the first image forming mode.

9. A color image forming apparatus according to claim 1, wherein in the first image forming mode, the image forming for the first sheet by a first image forming speed and the first registration control is performed by a first correction amount, and wherein in the second image forming mode, the image forming for the first sheet by a second image forming speed slower than the first image forming speed and the second registration control is performed by a second correction amount less than the first correction amount.

10. A color image forming apparatus according to claim 9, wherein in the first image forming mode, the first registration control corresponding to the image forming for the first sheet is performed by a third correction amount less than the first correction amount, and wherein in the second image forming mode, the second registration control corresponding to the image forming for the first sheet is performed by a fourth correction amount equal to the second correction amount.

11. A color image forming apparatus according to claim 1, wherein contact between the second process unit and the first process unit in the first image forming mode before the image forming for the second or subsequent sheets starts is greater than a contact between the second process unit and the first process unit in the second image forming mode before the image forming for the second or subsequent sheets starts.

12. A color image forming apparatus according to claim 1, wherein the second process unit and the image bearing member or the conveyance member are driven by a common drive source.

13. A color image forming apparatus, comprising:

a photosensitive member;

a developing unit including a plurality of developing devices that develop electrostatic latent images formed on the photosensitive member with different color toners as a toner image;

an image bearing member for transferring a toner image formed on the photosensitive member, or a conveyance member that conveys a sheet onto which the toner image is transferred;

a detection unit that detects a mark formed on the image bearing member or the conveyance member, wherein according to a detection of the mark by the detection section, said color image forming apparatus performs contact control in which one of the plurality of developing devices contacts with the photosensitive member, or the one of the plurality of developing devices is separated from a state in which the developing device contacts with the photosensitive member to form a toner image on the photosensitive member, and image forming after stand-by for a time period, and said color image forming apparatus repeatedly performs the contact control and the image forming for each of sheets; and a control unit that, when an image forming for a first sheet is performed, performs the contact control for the one of the plurality of developing devices and also performs first registration control that corresponds to image forming for the first sheet according to the detection of the mark by the detection unit, and when an image forming for a second or subsequent sheets is performed, performs the contact control for the one of the plurality of developing devices and also performs second registration control that corresponds to image forming for the second or subsequent sheets according to the detection of the mark by the detection unit, wherein said color image forming apparatus is operable in a first image forming mode and in a second image forming mode, the contact control in the first image forming mode being different from the contact control in the second image forming mode, and wherein the control unit differentiates a correction amount for alignment in the second registration control in the first image forming mode from a correction amount for alignment in the second registration control in the second image forming mode.

14. A color image forming apparatus according to claim 13, wherein the control unit sets the correction amount according to a resistance value of the image bearing member or the conveyance member.

15. A color image forming apparatus according to claim 13, wherein the control unit sets the correction amount according to an environmental condition of the color image forming apparatus.

16. A color image forming apparatus according to claim 13, wherein the control unit varies the correction amount with respect to each of a plurality of colors.

17. A color image forming apparatus according to claim 13, wherein in the first image forming mode, the image forming for the first sheet is performed by a first image forming speed and the first registration control is performed by a first correction amount, and wherein in the second image forming mode, the image forming for the first sheet is performed by a second image forming speed slower than the first image forming speed and the second registration control is performed by a second correction amount less than the first correction amount.

18. A color image forming apparatus according to claim 17, wherein in the first image forming mode, the first registration control corresponding to the image forming for the first sheet is performed by a third correction amount less than the first correction amount, and wherein in the second image forming mode, the second registration control corresponding to the image forming for the first sheet is performed by a fourth correction amount equal to the second correction amount.

19. A color image forming apparatus according to claim 14, wherein contact between the one of the plurality of developing devices and the photosensitive member in the first image forming mode before the image forming for the second or subsequent sheets starts is greater than contact between the one of the plurality of developing devices and the photosensitive member in the second image forming mode before the image forming for the second or subsequent sheets starts.

20. A color image forming apparatus according to claim 13, wherein the developing unit includes a rotary developing device that rotates to make the one of the plurality of developing devices contact the photosensitive member.

21. A color image forming apparatus according to claim 13, wherein the developing unit and the image bearing member or the conveyance member are driven by a common drive source.

* * * * *